US006502548B2

(12) United States Patent
Kuretake

(10) Patent No.: US 6,502,548 B2
(45) Date of Patent: Jan. 7, 2003

(54) UNIT FOR CONTROLLING ELECTRONICALLY CONTROLLED THROTTLE VALVE

(75) Inventor: Ken Kuretake, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 09/916,575

(22) Filed: Jul. 30, 2001

(65) Prior Publication Data

US 2002/0139348 A1 Oct. 3, 2002

Related U.S. Application Data

(62) Division of application No. 09/369,634, filed on Aug. 6, 1999, now Pat. No. 6,293,249.

(30) Foreign Application Priority Data

Aug. 10, 1998 (JP) ..... 10-226034
Dec. 1, 1998 (JP) ..... 10-341740

(51) Int. Cl.[7] ..... F02D 1/00
(52) U.S. Cl. ..... 123/399; 123/396
(58) Field of Search ..... 123/399, 396

(56) References Cited

U.S. PATENT DOCUMENTS

| | | | |
|---|---|---|---|
| 5,749,343 A | 5/1998 | Nichols et al. | 123/396 |
| 5,755,201 A | 5/1998 | Knoss et al. | 123/396 |
| 5,983,859 A | 11/1999 | Bruedigam et al. | 123/396 |
| 5,983,861 A | 11/1999 | Nishio et al. | 123/396 |
| 6,044,318 A | 3/2000 | Bourdon et al. | 123/399 |
| 6,089,535 A | 7/2000 | Mizutani et al. | 123/399 |

FOREIGN PATENT DOCUMENTS

| | | |
|---|---|---|
| DE | 39 37 102 | 5/1990 |
| DE | 196 10 210 | 9/1997 |
| EP | 0 604 149 | 6/1994 |
| JP | 08-326561 | 12/1996 |
| JP | 09-242591 | 9/1997 |

OTHER PUBLICATIONS

Patent Abstracts of Japan, vol. 1998, No. 14, Dec. 31, 1998 & JP 10–238390 (Denso Corp; Toyota Motor Corp), Sep. 8, 1998.

*Primary Examiner*—John Kwon
(74) *Attorney, Agent, or Firm*—Kenyon & Kenyon

(57) ABSTRACT

A control unit for detecting an opening of an accelerator and an opening of the throttle valve to operate the throttle valve via a motor, sets a commanded value of an opening of the throttle valve at each of first predetermined cycles in accordance with an of the accelerator. A first opening/closing velocity is set in accordance with the set commanded value, a present opening of the throttle valve is read at each of second cycles shorter than the first predetermined cycles, the motor is rotated to open/close the throttle valve to follow a first predicted opening of the throttle valve until the opening of the throttle valve is smaller than the commanded value by a predetermined quantity, and the motor is caused to open/close the throttle valve to follow a second predicted opening of the throttle valve which is smaller than the first predicted opening of the throttle valve after the cycle when the opening of the throttle valve has been made smaller than the commanded value by a predetermined quantity. As a result, high-speed response of the throttle valve and prevention of overshoot can be realized.

2 Claims, 21 Drawing Sheets

(a)

UNIT FOR CONTROLLING ELECTRONICALLY CONTROLLED THROTTLE VALVE

This is a division of application Ser. No. 09/369,634 filed Aug. 6, 1999, now U.S. Pat. No. 6,293,249.

INCORPORATION BY REFERENCE

The disclosure of Japanese Patent Applications No. HEI 10-226034 filed on Aug. 10, 1998 and No. HEI 10-341740 filed on Dec. 1, 1998, including the specification, drawings and abstracts thereof are incorporated herein by reference in their entirety.

BACKGROUND OF THE INVENTION

1. Field of the Invention

The present invention relates to a control unit, and more particularly to a control unit for an electronically controlled throttle valve which is capable of raising response speed of an electronically controlled throttle valve having a structure in which an acceleration pedal and the throttle valve are not mechanically connected to each other.

2. Description of the Related Art

Hitherto, control of the number of revolutions of an internal combustion engine mounted on a vehicle has been performed in accordance with an amount of depression of an acceleration pedal disposed in a driver's compartment adjacent to a foot of a driver. That is, internal combustion engines have generally incorporated a throttle valve disposed in a suction passage of the engine with the throttle valve connected to the acceleration pedal by a wire. When the acceleration pedal is depressed, the opening of the throttle valve is enlarged. Thus, an amount of air admitted into the internal combustion engine is enlarged, leading to an increased consumption of fuel. As a result, the number of revolutions of the internal combustion engine is enlarged.

Recent advances with computers have lead to the increased use of electronically controlled internal combustion engines which optimally control revolution speed of the engine. Electronic control of the internal combustion engine, for example, control of an amount of fuel injection, control of an ignition timing, and control of a timing at which a suction/exhaust valve operates have been previously developed and have been followed by the practical application of the electronic control of the throttle valve.

The structure of an electronically controlled throttle valve unit is shown in FIG. 1. The electronically controlled throttle valve unit 20 incorporates a throttle lever 16 connected to an acceleration pedal (not shown) by a wire; an accelerator opening sensor 15 contained in the throttle lever 16 for detecting an opening of an accelerator corresponding to an amount of depression of the accelerator pedal; an engine control unit (hereinafter called an "ECU") 10 to which the opening of the accelerator detected by the accelerator opening sensor 15 is input; a throttle motor 4 for opening/closing a throttle valve 3 disposed in a suction passage 2 of the internal combustion engine in accordance with an output of the ECU 10; a throttle opening sensor 5 for detecting an opening of the throttle valve 3; a lever 17 for withdrawal running; a return spring 18 for the throttle valve 3; and a relief spring 19 for the lever 17 for withdrawal running. The throttle motor 4 has a built-in electromagnetic clutch.

In the electronically controlled throttle valve unit 20 structured as described above, when the acceleration pedal is depressed in accordance with the intention of a driver, the amount of depression of the acceleration pedal is transmitted to the throttle lever 16 by the wire. As a result, the throttle lever 16 is rotated. The throttle lever 16 includes the accelerator opening sensor 15. In accordance with the angle of rotation of the throttle lever 16, the amount of depression of the acceleration pedal is detected. The amount of depression of the acceleration pedal detected by the accelerator opening sensor 15 is sent to the ECU 10. The ECU 10 determines the opening of the throttle valve 3 in accordance with the detected amount of depression of the acceleration pedal so as to rotate the throttle motor 4. The opening of the throttle valve 3 is detected by the throttle opening sensor 5 so as to be fed back to the ECU 10. The throttle motor 4 must be a motor exhibiting quick response and small power consumption.

To perform the above-mentioned control, a signal transmitted from the throttle opening sensor 5 for detecting the opening of the throttle valve 3 is used. Moreover, a feedback control of the throttle motor 4 is performed by using proportion (P), integration (I) and differentiation (D) (hereinafter simply called "PID control") to eliminate deviation from the signal transmitted from the accelerator opening sensor 15.

In recent years, electronic throttle apparatus have been suggested which are structured such that the wire between the acceleration pedal and the throttle valve 3 is eliminated. The foregoing electronic throttle apparatus incorporate a rotational-angle sensor provided for a support shaft of the acceleration pedal. As an alternative to this, a stroke sensor for the acceleration pedal is provided. The value detected by the sensor is directly input to the ECU 10.

The ECU 10 determines the opening of the throttle valve 3 in response to a signal representing an opening of the acceleration pedal. Thus, the ECU 10 directly outputs an operating signal to the throttle motor 4. The opening of the throttle valve 3 is detected by the throttle opening sensor 5 so as to be fed back to the ECU 10. Note that the throttle opening sensor 5 may be contained in the throttle motor 4.

The control constants of the PID control including terms P, I and D have been fixed values determined by a tuning operation to satisfy specifications required for all of the running states of the system. Therefore, the conventional control unit for the electronically controlled throttle valve using the PID control cannot provide an optimum value for each running state of the engine. As a result, response and stability of the throttle valve 3 deteriorate.

To improve response of the operation of the throttle valve with respect to the acceleration pedal, an attempt has been made to enlarge the gain in the PID control. The foregoing structure encounters another problem of causing overshoot at the time of acceleration and undershoot at the time of deceleration. To improve response of the operation of the throttle valve with respect to the acceleration pedal, a structure has been employed in which sampling cycles for detecting the opening of the throttle valve are shortened to quickly follow a target value (commanded value) in the PID control. If the sampling cycles are shortened to reduce the controlling intervals of the throttle motor 4, overshoot and undershoot may easily occur.

Therefore, Japanese Patent Application Laid-Open No. HEI 8-326561 has been disclosed to overcome the problem of the overshoot and undershoot with respect to the target value of the opening of the throttle valve. According to the foregoing disclosure, a method has been suggested with which the PID control of the throttle valve is performed such that a state of the operation of the throttle valve is determined. If the determination is made that the throttle valve is being operated in a state in which the opening is larger than the target opening which is determined in accordance with the amount of depression of the acceleration pedal, it is determined that overshoot of the throttle valve has occurred. Thus, the gain (the differential term D) for use in the PID control is changed.

If the gain is changed after the determination of the overshoot of the throttle valve as is suggested in Japanese Patent Application Laid-Open No. HEI 8-326561, the throttle valve has already been within the overshoot region. Therefore, there arises a problem of insufficient response to restore the throttle valve to a normal operation state.

SUMMARY OF THE INVENTION

Accordingly, an object of the present invention is to provide a control unit for an electronically controlled throttle valve for performing PID control capable of realizing both high-speed response of the electronically controlled throttle valve and prevention of overshoot by raising the velocity at which the throttle valve is opened/closed in accordance with a commanded value for the opening of the throttle valve and by monitoring the opening/closing velocity of the throttle valve to reduce the opening/closing velocity of the throttle valve after a moment at which the opening of the throttle valve has approached the opening based on the commanded value.

To achieve the foregoing object, according to an aspect of the present invention, there is provided a control unit including an accelerator opening sensor for detecting an accelerator opening in accordance with an amount of depression of an acceleration pedal, a throttle-valve opening sensor for detecting an opening of a throttle valve disposed in a suction passage of an internal combustion engine, a motor for opening/closing the throttle valve in accordance with values detected by the accelerator opening sensor and the throttle-valve opening sensor, commanded-value setting means for setting a commanded value of the opening of the throttle valve in accordance with the accelerator value, first controlled-variable setting means for setting a first controlled variable of the throttle valve in accordance with the commanded value, second controlled-variable setting means for setting a second controlled variable in accordance with the first controlled variable when the difference between the present opening of the throttle valve and a previous opening of the throttle valve is smaller than a predetermined value, and controlled-variable output means for outputting the first and second controlled variables to the motor for opening the throttle valve until the opening reaches the commanded value of the opening of the throttle valve.

DESCRIPTION OF THE PREFERRED EMBODIMENT

Figure 1:
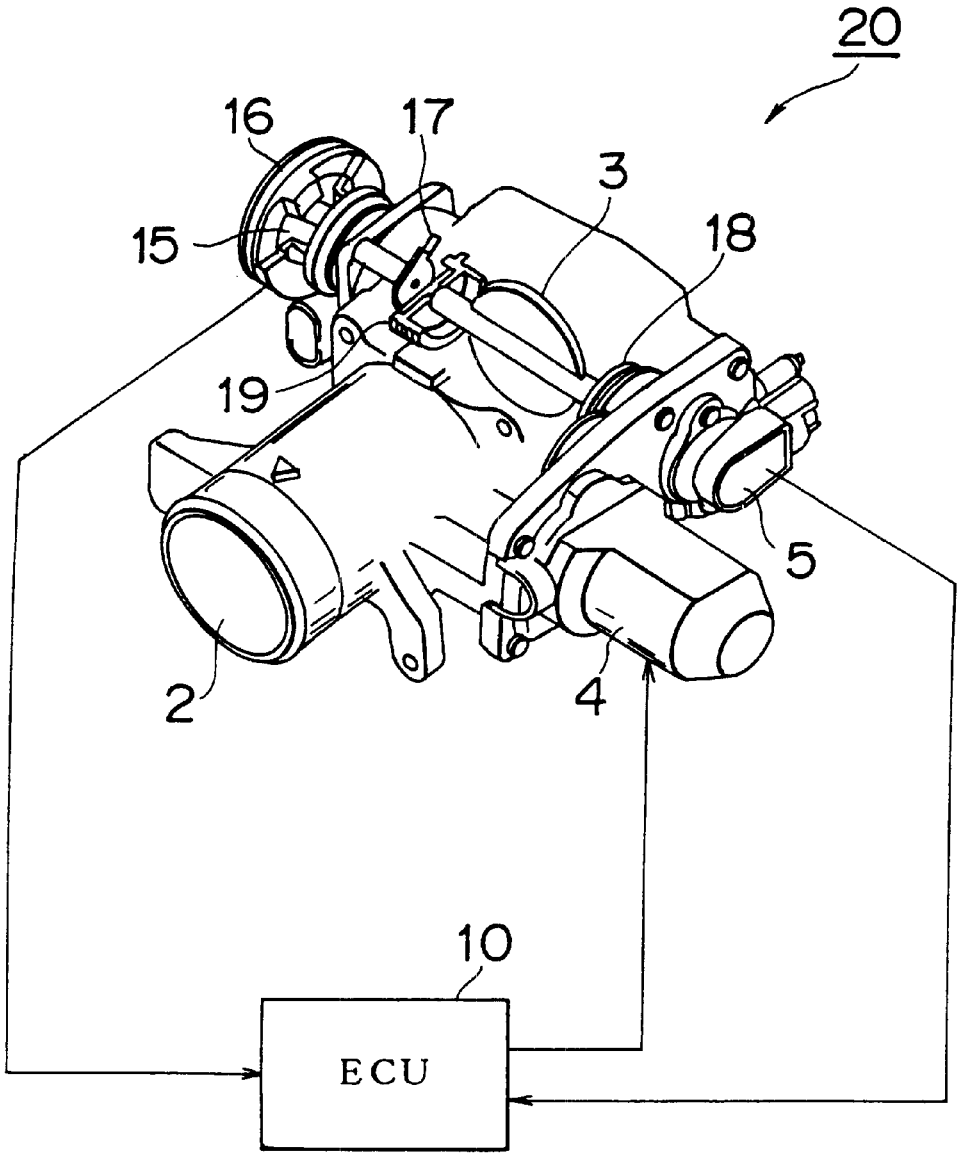
FIG. 1 is a perspective view showing the structure of an electronically controlled throttle.

Referring to the drawings, embodiments of the present invention will now be described. Note that the same elements as those of the electronically controlled throttle valve unit 20 described with reference to FIG. 1 are given the same reference numerals.

Figure 2:
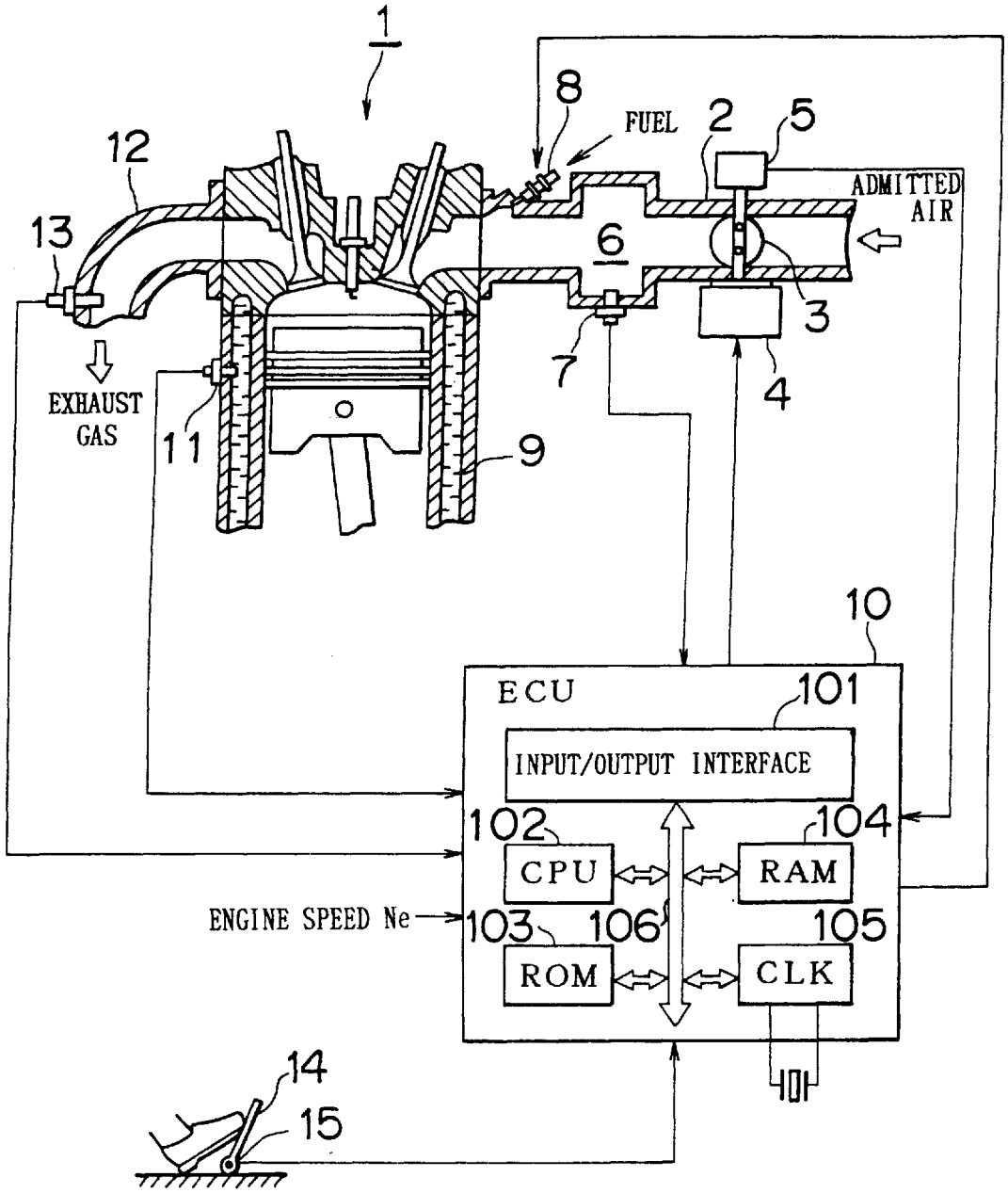
FIG. 2 is a diagram showing the structure of an electronically-controlled, multi-cylinder internal combustion engine on which the control unit according to an embodiment of the present invention has been mounted.

FIG. 2 schematically shows an electronically controlled fuel injection and multiple-cylinder internal combustion engine 1 incorporating the control unit for a throttle valve according to an embodiment of the present invention. Referring to FIG. 2, a suction passage 2 of the internal combustion engine 1 is provided with a throttle valve 3 disposed downstream of an air cleaner (not shown). A throttle motor 4 which is an actuator for operating the throttle valve 3 is disposed at an end of a shaft of the throttle valve 3. On the other hand, a throttle opening sensor 5 for detecting the opening of the throttle valve 3 is disposed at another end of the foregoing shaft. That is, the throttle valve 3 according to this embodiment is an electronically controlled throttle which is opened/closed by the throttle motor 4.

A surge tank 6 is disposed in the suction passage 2 at a position downstream of the throttle valve 3. A pressure sensor 7 for detecting the pressure of admitted air is disposed in the surge tank 6. Moreover, a fuel injection valve 8 for supplying pressurized fuel from a fuel supply system to a suction port is disposed at a position downstream of the surge tank 6, the fuel injection valve 8 being provided for each cylinder. An output of the throttle opening sensor 5 and that of the pressure sensor 7 are supplied to an ECU (Engine Control Unit) 10 including a microcomputer.

A water-temperature sensor 11 for detecting the temperature of cooling water is disposed in a cooling-water passage 9 of the cylinder block of the internal combustion engine 1. The water-temperature sensor 11 generates an analog-voltage electric signal corresponding to the temperature of the cooling water. The exhaust-gas passage 12 is provided with a three way catalytic converter (not shown) for simultaneously purifying hazardous components which are HC, CO and NOx contained in exhaust gas. An $O_2$ sensor 13 which is one of air-fuel ratio sensor is disposed in the exhaust-gas passage 12 at the position upstream of the catalytic converter. The $O_2$ sensor 13 generates an electric signal to correspond to the density of an oxygen component contained in the exhaust gas. Outputs of the water-temperature sensor 11 and the $O_2$ sensor 13 are supplied to the ECU 10.

The ECU 10 is furthermore supplied with a signal representing an amount of depression of the acceleration pedal (an accelerator opening signal) supplied from an accelerator opening sensor 15 joined to the accelerator pedal 14 and arranged to detect the amount of depression of the accelerator. Moreover, the ECU 10 is supplied with engine speed Ne of the engine from a crank angle sensor joined to a distributor (not shown).

The structure is arranged as described above. When a key switch (not shown) is switched on, the ECU 10 is energized so that a program is started. Thus, the ECU 10 extracts outputs from the foregoing sensors and controls the throttle motor 4 for opening/closing the throttle valve 3 and the fuel injection valve 8 or the other actuators. The ECU 10 incorporates an A/D converter for converting analog signals supplied from the various sensors into digital signals. Moreover, the ECU 10 incorporates an input/output interface 101 through which digital signals supplied from the various sensors and signals for operating the various actuators are input/output, a CPU 102 for performing a calculating process, memories, such as a ROM 103 and a RAM 104, and a clock 105. The foregoing units are connected to one another through a bus 106. Since the structure of the ECU 10 has been already known, further description is omitted.

Figure 3A:
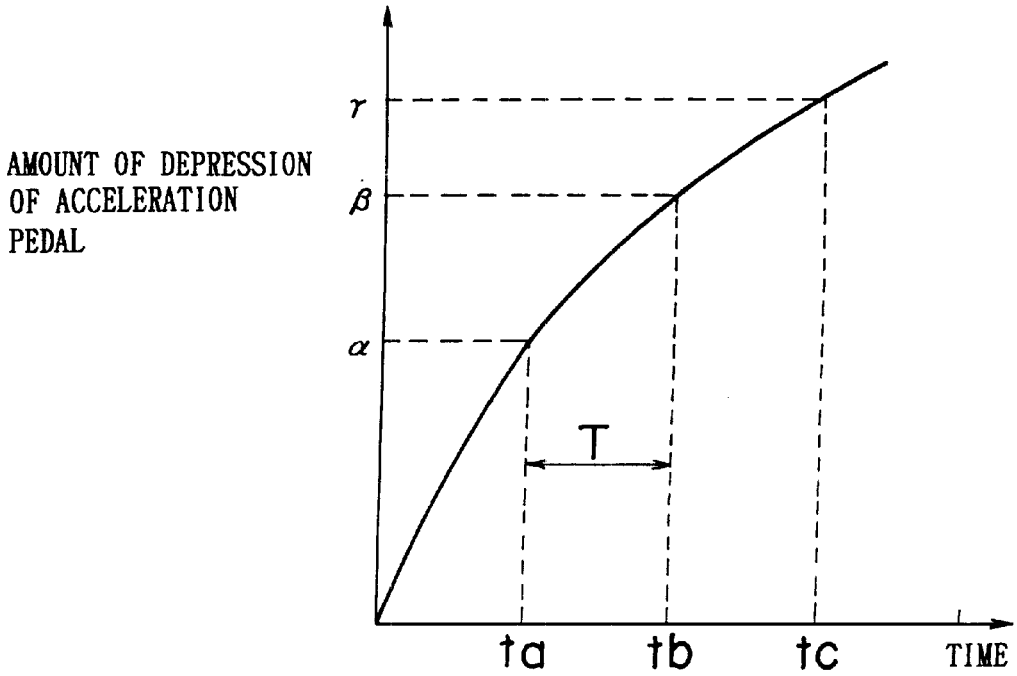
FIG. 3A is a graph showing an example of a characteristic of amount of depression of an acceleration pedal.
Figure 3B:
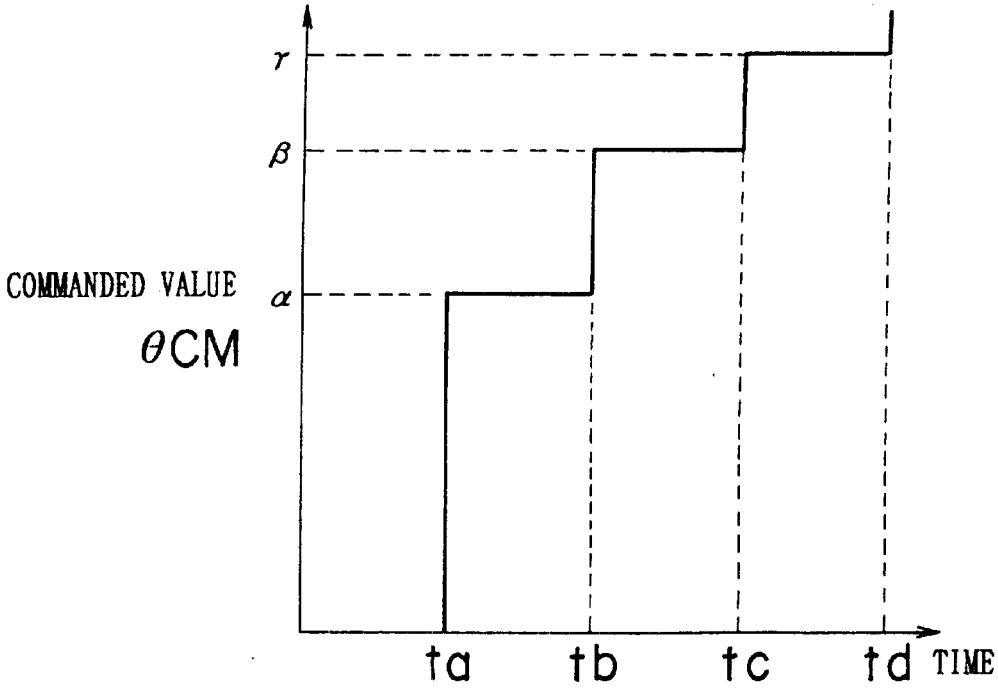
FIG. 3B is a graph showing a characteristic of a commanded value obtainable from the characteristic of the amount of depression of the acceleration pedal shown in FIG. 3A.

When the signal representing the amount of depression of the acceleration pedal has been input to the ECU 10 from the accelerator opening sensor 15, the ECU 10 samples the signal representing the amount of depression of the acceleration pedal at predetermined cycles T, for example, cycles of 10 ms, as shown in FIG. 3A. Then, the ECU 10 outputs sampled value $\alpha$ at time ta as commanded value $\theta CM$ of the opening of the throttle valve at time ta, as shown in FIG. 3B. Then, the ECU 10 similarly outputs the signal representing the amount of depression of the acceleration pedal and sampled at the predetermined cycles T such that the signal is output as commanded value $\theta CM=\beta$ at time tb and commanded value $\theta CM=\gamma$ at time tc.

Figure 4:
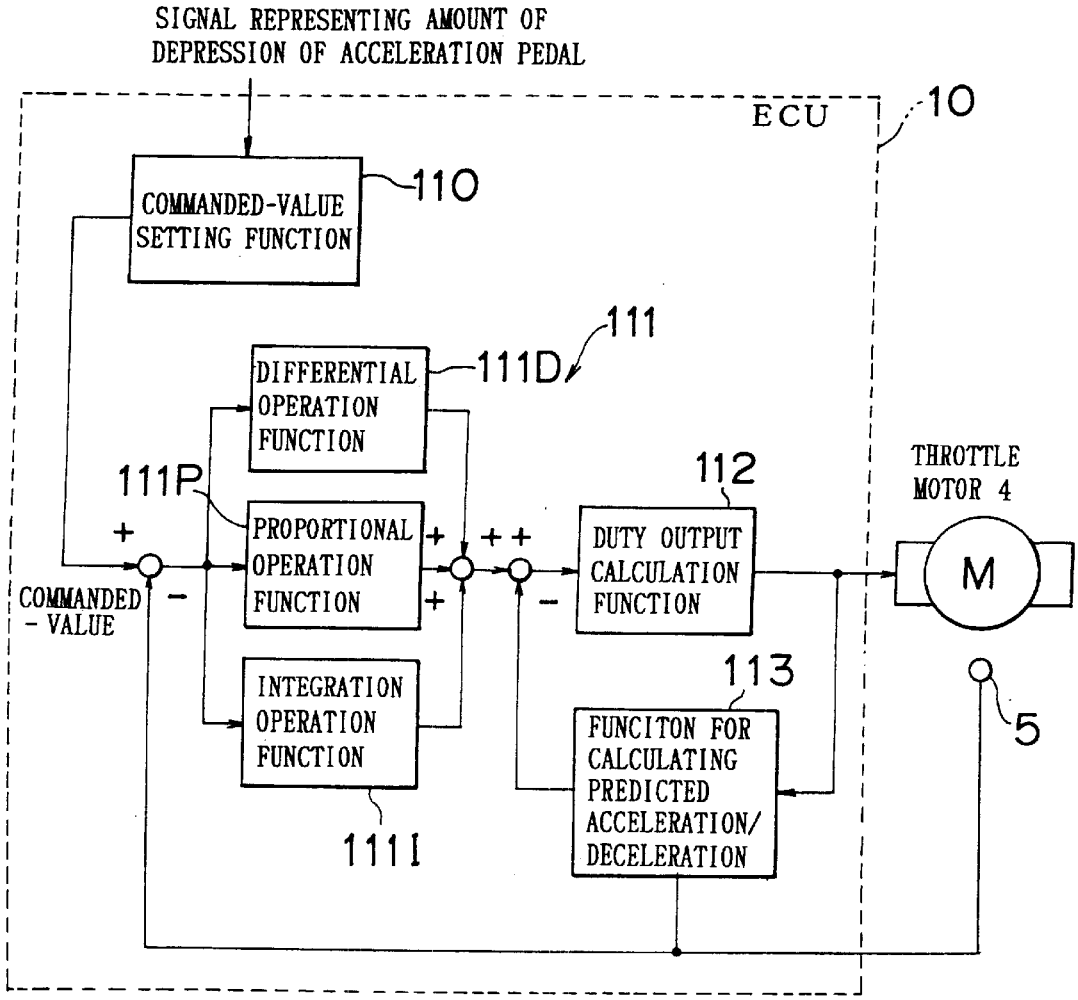
FIG. 4 is a block diagram showing a control operation according to a first embodiment of the present invention.

FIG. 4 is a block diagram showing functions of the ECU 10 shown in FIG. 2. When the signal representing the amount of depression of the acceleration pedal has been supplied to the ECU 10, a commanded-value setting function 110 produces a commanded value at the predetermined time T. The commanded value is supplied to a PID control function 111 constituted by a differential operation function 111D, a proportional operation function 111P and an integration operation function 111I. In accordance with the commanded value, the PID control function 111 calculates an opening/closing velocity of the throttle valve. Then, the PID control function 111 outputs a target value of the opening of the throttle valve which is determined by the opening/closing velocity of the throttle valve. The target value of the opening of the throttle valve is output to a duty output calculating function 112. The duty output calculating function 112 calculates a duty ratio of an operating signal for the throttle motor in accordance with the target value of the opening of the throttle valve. The duty ratio of an operating signal for the throttle motor is output to the throttle motor 4. Thus, the throttle motor 4 is rotated so that the opening of the throttle valve is changed. The opening of the throttle valve is detected by the throttle opening sensor 5. A detected value is fed back to the PID control function 111.

The system for controlling the throttle valve has the above-mentioned functions. The control system according to the present invention has an acceleration/deceleration prediction calculating function 113 added thereto. The acceleration/deceleration prediction calculating function 113 extracts the output of the duty output calculating function 112 and controls the output of the duty output calculating function 112 by feeding back a predetermined signal to an input portion of the duty output calculating function 112. The opening of the throttle valve detected by the throttle opening sensor 5 is also input to the acceleration/deceleration prediction calculating function 113.

A first embodiment of the control according to the present invention for use in the control unit having the above-mentioned structure shown in FIG. 4 will now be described with reference to a flow chart shown in FIG. 5. The procedure shown in the foregoing flow chart is performed at individual sampling cycles Ts shorter than the foregoing sampling cycles T. It is assumed that m is a natural number, T=mTs.

In step 501, it is determined whether or not the present time is the sampling period T. If the present time is the sampling period T, the operation proceeds to step 502 where a present opening (the amount of depression of the acceleration pedal) detected by the accelerator opening sensor 15 is read as shown in FIGS. 3A and 3B. The read opening is made to be a present commanded value θCM of the opening of the throttle valve. In step 503, first opening/closing velocity V1 of the throttle valve is calculated in accordance with the magnitude of the commanded value θCM. Then, the operation proceeds to step 504.

The first opening/closing velocity V1 indicates an upper limit for a follow-up velocity of the opening of the throttle valve with respect to the commanded value θCM. The follow-up velocity of the opening of the throttle valve with respect to the commanded value θCM is guarded with the first opening/closing velocity V1. The first opening/closing velocity V1 may be determined in accordance with the magnitude of the commanded value θCM at the time at which the first opening/closing velocity V1 is calculated by forming the same into a map which is previously stored in the ROM 103. Also the first opening/closing velocity V1 of the throttle valve can be obtained by present control. That is, also the first opening/closing velocity V1 of the throttle valve can be obtained by producing a state equation by using parameters including the commanded value θCM, the amount of depression of the accelerator pedal, the voltage of a battery and the temperature detected at the time at which the first opening/closing velocity V1 is calculated.

If it is determined in step 501 that the present time t1 is not the sampling period T, steps 502 and 503 are not performed. In this case, the operation proceeds to step 504.

In step 504, the opening θth of the throttle valve 3 is read in accordance with an output denoting the result of detection performed by the throttle opening sensor 5. In step 505, predicted opening θe1 of the throttle valve after a lapse of predetermined time Ts (after next sampling cycle Ts) in accordance with the first opening/closing velocity V1 of the throttle valve calculated in step 503 and the present opening θth of the throttle valve 3. The predicted opening θe1 of the throttle valve is a quantity which is expressed as the difference from the present opening θth of the throttle valve.

In step 506, an amount of rotations of the throttle motor 4 for operating the throttle valve 3 is calculated as a drive duty ratio DD1 to correspond to the predicted opening θe1 of the throttle valve calculated in step 505. The drive duty ratio DD1 can be calculated in accordance with the map made to correspond to the predicted opening θe1 of the throttle valve.

Figure 6:
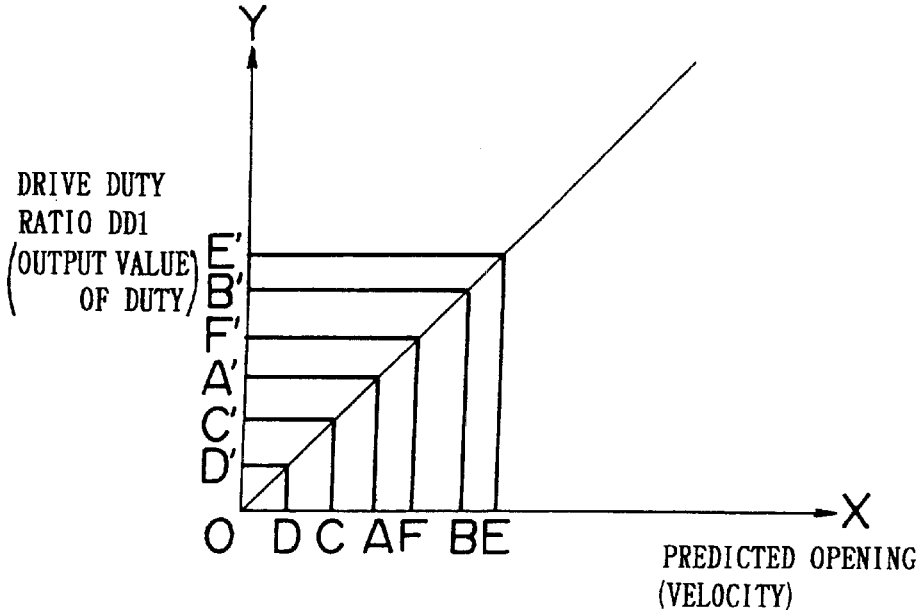
FIG. 6 is a graph showing the characteristic of the relationship between predicted opening of the throttle valve and the drive duty ratio.
Figure 7:
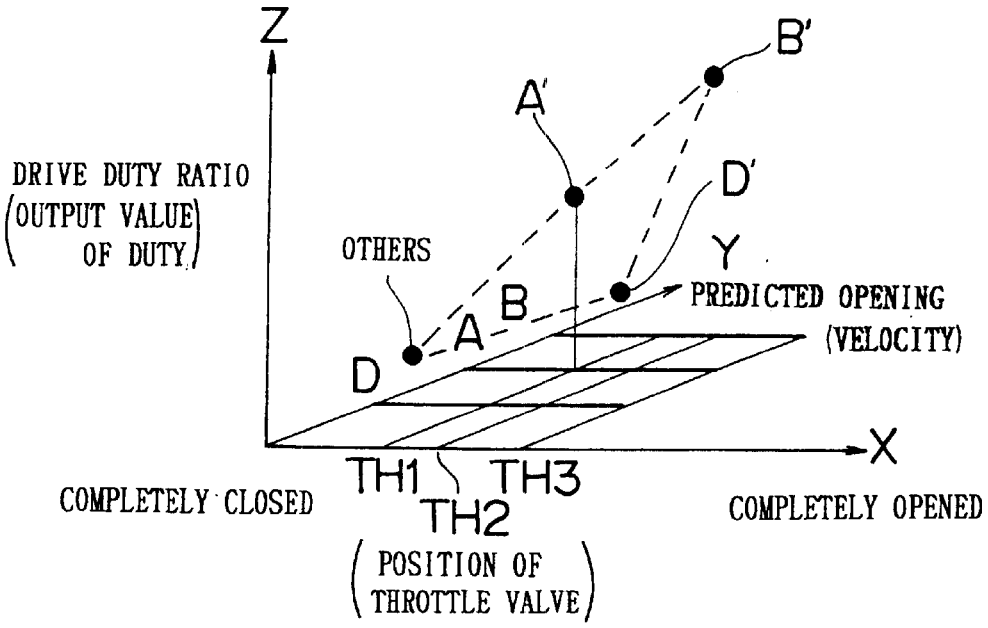
FIG. 7 is a graph showing the relationship among the position of the throttle valve, predicted opening of the throttle valve and drive duty ratio in a three-dimensional manner.

Examples of the foregoing map are shown in FIGS. 6 and 7. FIG. 6 shows an example of a map having the X-axis standing for predicted opening (the velocity) and the Y-axis standing for drive duty ratios DD1. In accordance with the foregoing map, the drive duty ratio DD1 corresponding to the predicted opening θe1 can be obtained. FIG. 7 shows an example of a map having the X-axis standing for the positions of the throttle valve, the Y-axis standing for the predicted openings of the throttle valve and the Z-axis standing for the drive duty ratios DD1. The map shown in FIG. 7 enables the value of the drive duty ratio DD1 corresponding to the predicted opening θe1 to be obtained in consideration of the present position of the throttle valve (the opening of the throttle valve). Therefore, a further accurate drive duty ratio DD1 can be obtained.

In this embodiment, the foregoing control is performed until the opening θth is enlarged to a predetermined opening near the commanded value θCM of the opening of the throttle valve 3. The predetermined opening varies depending on the performance of the engine. The predetermined opening is required to be, for example, about 85% of the commanded value θCM of the opening of the throttle valve. Then, the description will be performed such that the predetermined opening is 85% of the commanded value θCM of the opening of the throttle valve.

In step 507, it is determined whether or not the opening θth of the throttle valve 3 has been enlarged to the predetermined opening near the commanded value θCM of the opening of the throttle valve, that is, it is determined whether or not the opening θth of the throttle valve 3 has been enlarged to 85% of the commanded value θCM. If θth<θCM×0.85 in step 507, the drive duty ratio DD1 obtained by the procedure in step 502 to step 506 is as it is used to rotate the throttle motor 4. Therefore, if θth<θCM×0.85 in step 507, the operation proceeds to step 508 where a flag n, to be described later, is made to be 0. Then in step 16, the drive duty ratio DD1 calculated in step 5 is output as the duty ratio for rotating the throttle motor 4. Thus, the foregoing routine is completed.

Figure 8:
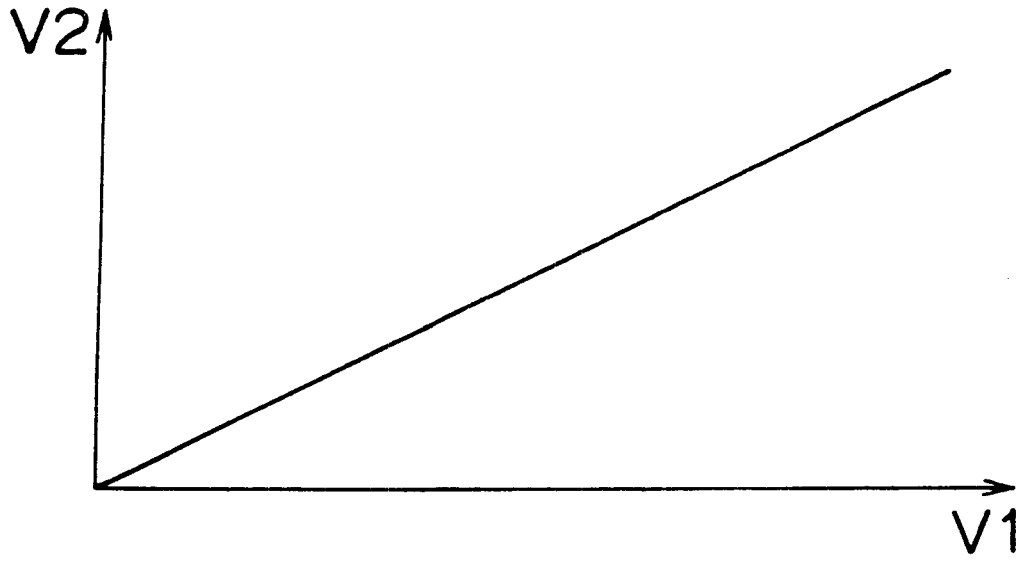
FIG. 8 is a graph showing the characteristic of the relationship between first and second opening/closing velocities of the throttle valve according to the present invention.

If θth≧θCM×0.85 in step 507, the operation proceeds to step 509. In step 509, it is determined whether or not θth≧θCM×0.85 has been first satisfied in step 507 in accordance with the value of the flag. That is, if θth≧θCM×0.85 has been first satisfied in step 507, the value of the flag n is zero. Therefore, the process in steps 510 and 511 are performed. When the value of the flag n is zero, the operation proceeds to step 510 where second opening/closing velocity V2 of the throttle valve is calculated in accordance with the first opening/closing velocity V1 of the throttle valve. The second opening/closing velocity V2 of the throttle valve is smaller than the first opening/closing velocity V1 of the throttle valve. The second opening/closing velocity V2 can be calculated by using the map shown in FIG. 8 and previously set in accordance with the furst opening/closing velocity V1 of the throttle valve. The map shown in FIG. 8 is required to be corrected in accordance with the state of the throttle motor, the voltage of the battery mounted on the engine or the atmospheric temperature.

After the second opening/closing velocity V2 of the throttle valve has been calculated in step 510, the operation proceeds to step 511 where the value of the flag n is made to be 1. Then the operation proceeds to step 512. When the operation proceeds to step 509 afterwards, the value of the flag n has been made to be 1. Therefore, the processes is steps 510 and 511 are not performed. In this case, the operation proceeds to step 512. As described above, the flag n is provided for causing the second opening/closing velocity V2 of the throttle valve to be calculated in step 510 only when θth ≧θCM×0.85 is first satisfied in step 507.

In step 512, predicted opening θe2 of the throttle valve after a lapse of the predetermined time Ts is calculated in accordance with the second opening/closing velocity V2 of the throttle valve calculated in step 510 and the present opening θth of the throttle valve 3 read in step 504.

In step 513, difference θthdf between the predicted opening θe1 of the throttle valve calculated in step 505 and the predicted opening θe2 of the throttle valve calculated in step 512 is calculated. In step 514, change DDΔ of the drive duty ratio DD1 of the throttle motor 4 which operates the throttle valve 3 is calculated to correspond to the difference θthdf. The change DDΔ of the drive duty ratio can be calculated by directly using the map caused to correspond to the predicted opening θe1 of the throttle valve.

In step 515, the drive duty ratio DD1 of the throttle valve calculated in step 506 is corrected with the change DDΔ of the drive duty ratio calculated in step 514. After the process in step 515 has been completed, the operation proceeds to step 516 where the corrected drive duty ratio DD1 of the throttle valve is output as the drive duty ratio of the throttle motor 4. Thus, the foregoing routine is completed.

Therefore, after $\theta th \geq \theta CM \times 0.85$ has been satisfied in step 507, the drive duty ratio DD1 which is output in step 516 is the value obtained in step 515 by correcting the drive duty ratio DD1 of the throttle motor 4 calculated in step 506. The corrected drive duty ratio DD1 is used to rotate the throttle motor 4.

Figure 9:
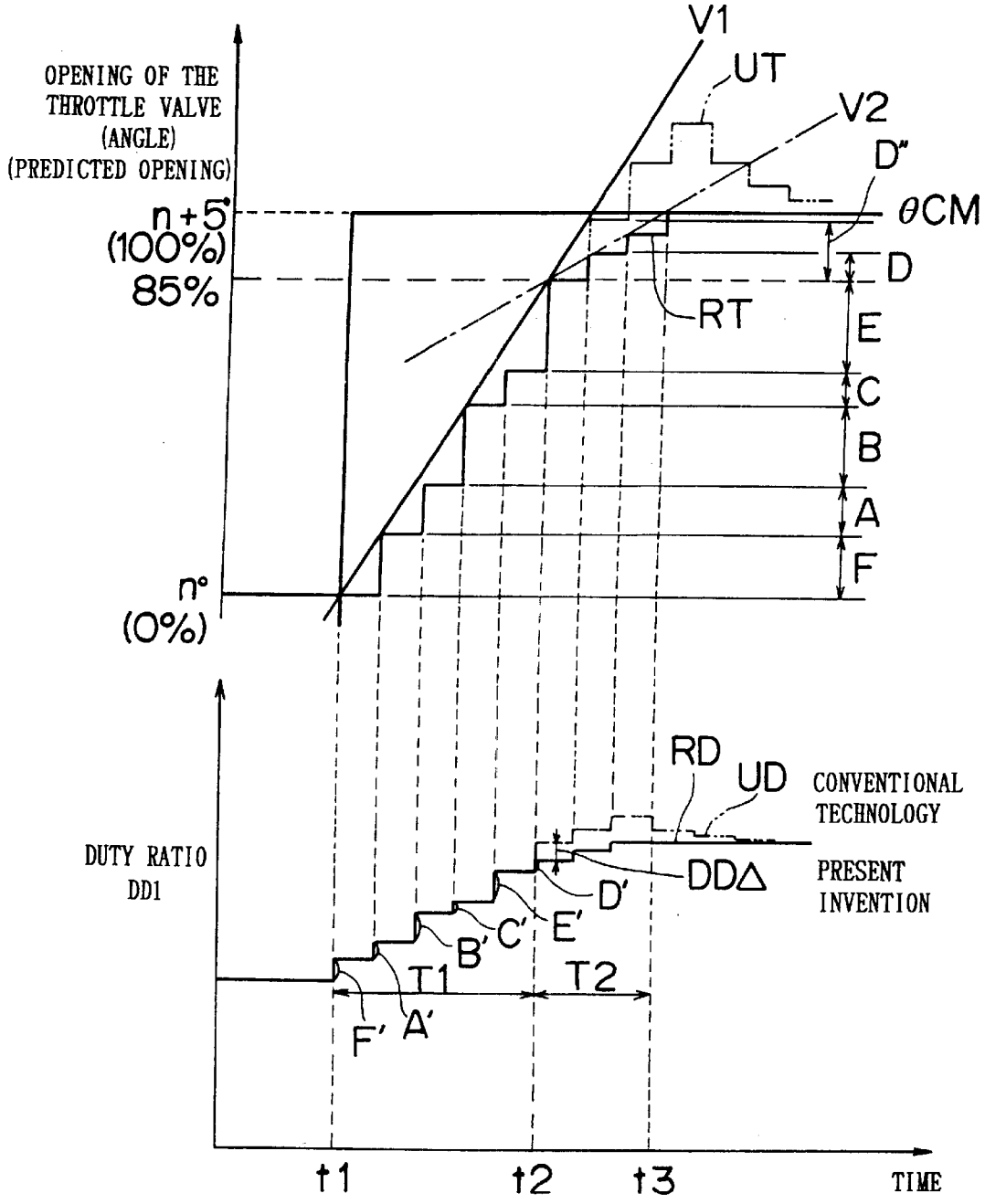
FIG. 9 is a time chart showing a state of change in a commanded value in the control procedure shown in FIG. 5, the first and second opening velocities, predicted opening of the throttle valve and the drive duty ratio.

FIG. 9 is a time chart for use when the time t1 corresponds to the calculating cycles of the commanded value θCM and showing change in the commanded value θCM, the opening of the throttle valve (predicted openings θe1 and θe2) and the drive duty ratio DD1 of the throttle motor with time. It is assumed that the opening θth of the throttle valve is n° and the commanded value θCM calculated in step 502 is 5°.

Under the foregoing conditions, the first opening/closing velocity V1 of the throttle valve is calculated in accordance with the value of the commanded value θCM which is 5° (step 503). Then value 5° as the present opening θth of the throttle valve is read (step 504). Then, the predicted opening θe1 of the throttle valve after a lapse of the sampling cycle Ts is calculated (step 505). Note that the predicted opening of the throttle valve after a lapse of the sampling cycle Ts is made to be F.

When the predicted opening of the throttle valve after a lapse of the sampling cycle Ts has been calculated as F, the corresponding drive duty ratio DD1 of the throttle motor is calculated (step 806). Thus, the throttle motor is duty-rotated with the foregoing drive duty ratio DD1 (step 516).

The duty rotation of the throttle motor is continued from time t1 to time t2 for period T1. When the predicted opening θe1 of the throttle valve has been changed to F, A, B, C and E during the period T1 as shown in the graph, the drive duty ratio DD1 of the throttle motor is accordingly changed to F', A', B', C' and E'. The control in the period T1 is the control using the PID control.

If the opening θth of the throttle valve has been enlarged to 85% of the commanded value θCM at time t2, the second opening/closing velocity V2 of the throttle valve is, at time t2, calculated to correspond to the first opening/closing velocity V1 of the throttle valve (step 510). Note that the predicted opening θe2 of the throttle valve after a lapse of sampling cycle Ts is calculated (step 512). Then, the predicted opening θe1 of the throttle valve after a lapse of sampling cycle Ts is made to be D" and the predicted opening θe2 of the throttle valve is made to be D.

When the opening θth of the throttle valve has been enlarged to 85% of the commanded value θCM, both of D" of the predicted opening θe1 corresponding to the first opening/closing velocity V1 of the throttle valve and D of the predicted opening θe2 are calculated. Thus, the difference θthdf between the two values is calculated (step 513). Then the change DDΔ of the duty ratio corresponding to the difference θthdf is calculated (step 514). Thus, the drive duty ratio DD1 of the throttle motor 4 is corrected with the change DDΔ of the duty ratio (step 515). Then the throttle motor is rotated with the corrected drive duty ratio DD1 in a period of T2 until time t3 at which the opening θth of the throttle valve coincides with the commanded value θCM. The period T2 is the period in which an acceleration/deceleration prediction calculation is performed in the PID control according to the present invention.

The control for opening the throttle valve has been described. When control is performed such that the throttle valve is closed, the sign of the magnitude of each of the commanded value θCM, the opening (predicted openings θe1 and θe2) of the throttle valve and the drive duty ratio DD1 of the throttle motor is made to be negative. Therefore, the other portions are the same. Thus, the foregoing control is omitted from description.

In the above-mentioned example, when the opening θth of the throttle valve has been enlarged to 85% of the commanded value θCM, the opening/closing velocity of the throttle valve is changed from the first opening/closing velocity V1 to the second opening/closing velocity V2 which is lower than the first opening/closing velocity V1. The change from the first opening/closing velocity V1 to the second opening/closing velocity V2 is not limited at the moment when the opening θth of the throttle valve has been enlarged to 85% of the commanded value θCM. The timing may arbitrarily be selected in accordance with the performance of the engine. The change may be performed when the opening θth of the throttle valve is made to be full close or near full open.

As described with reference to FIG. 9, according to the present invention, the predicted openings θe1 and θe2 of the throttle valve can appropriately be determined with respect to the commanded value θCM of the opening of the throttle valve as indicated with solid line RT. Moreover, the drive duty ratio DD1 of the throttle motor can appropriately be determined as indicated with solid line RD. Therefore, the throttle valve can smoothly be operated without causing overshoot and undershoot. On the other hand, the conventional control encounters the fact that the predicted opening θe1 of the throttle valve is raised with respect to the commanded value θCM of the opening of the throttle valve even after time t2 as indicated with an alternate long and two short dashes line UT. Therefore, also the drive duty ratio DD1 of the throttle valve is raised as indicated with an alternate long and two short dash line UD. As a result, overshoot and undershoot of the throttle valve take place.

Figure 10:
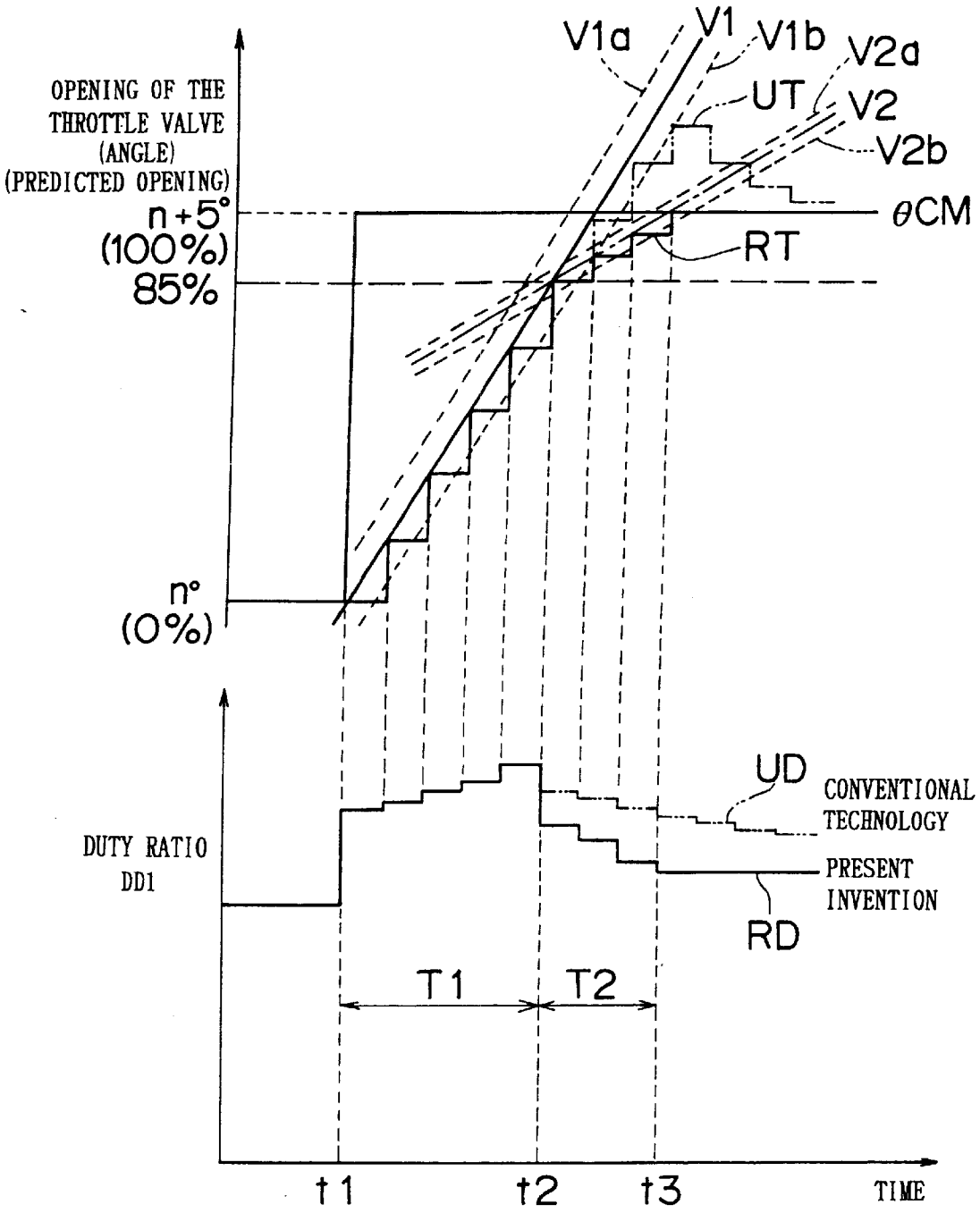
FIG. 10 is a time chart showing a state of change in a commanded value in the control procedure shown in FIG. 5, the first and second opening velocities, predicted opening of the throttle valve and the drive duty ratio when the gain in the PID control shown in FIG. 4 has been enlarged.

The example shown in FIG. 9 is structured such that the gain of the PID control is appropriately determined. Another example is shown in FIG. 10 in which the gain of the PID control is enlarged to cause the predicted opening θe1 of the throttle valve to always be guarded with the first opening/closing velocity V1. Also in the foregoing case, the predicted openings θe1 and θe2 of the throttle valve can appropriately be determined with respect to the commanded value θCM of the throttle valve as indicated with the solid line RT. Moreover, the drive duty ratio DD1 of the throttle motor can appropriately be determined as indicated with the solid line RD. Therefore, the throttle valve can smoothly be rotated without causing overshoot and undershoot.

The first and second opening/closing velocities V1 and V2 may be provided with allowances as indicated with dashed lines V1a, V1b and V2a, V2b shown in FIG. 10.

In the foregoing embodiment, even after the opening of the throttle valve has been enlarged to 85% of the commanded value θCM, also the predicted opening θe1 of the throttle valve corresponding to the first opening/closing velocity V1 of the throttle valve is calculated. Then the difference θthdf between the predicted opening θe2 corresponding to the second opening/closing velocity V2 of the throttle valve and the predicted opening θe1 is calculated. The difference θthdf between the predicted opening θe2 of the throttle valve corresponding the second opening/closing velocity V2 of the throttle valve and the predicted opening θe1 of the throttle valve is calculated. Then the change DDΔ of the duty ratio corresponding to the difference θthdf is calculated. The change DDΔ of the duty ratio of the throttle motor which can be obtained from the predicted opening θe1 of the throttle valve corresponding to the first opening/closing velocity V1 of the throttle valve is corrected with the change DDΔ. The throttle motor, thus, is rotated.

Figure 11:
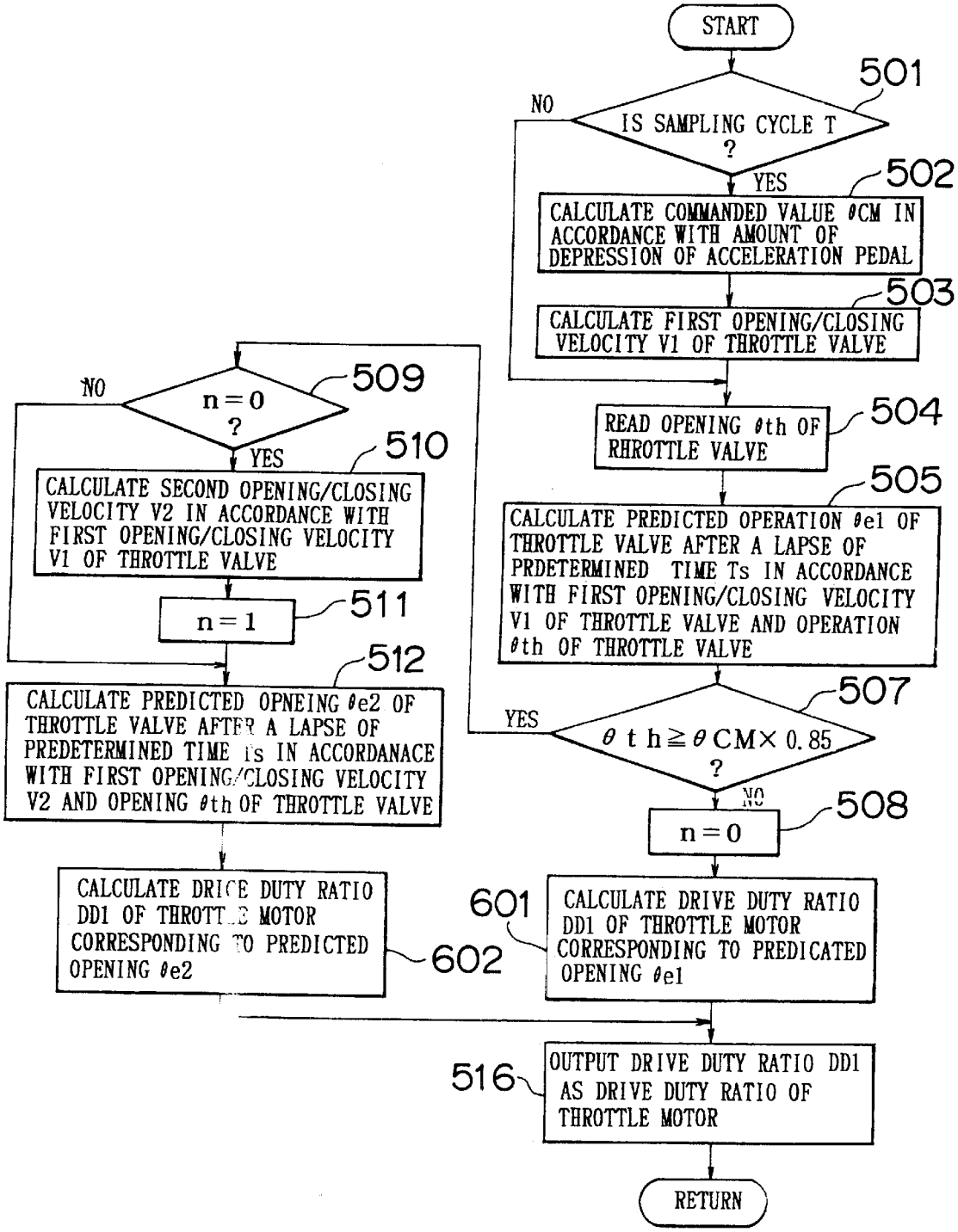
FIG. 11 is a flow chart of a control procedure for the throttle valve according to a second embodiment of the control unit according to the present invention.

After the opening θth of the throttle valve has been enlarged to 85% of the commanded value θCM, the drive duty ratio DD1 of the throttle motor may directly be calculated from the predicted opening θe2 of the throttle valve of the throttle valve corresponding to the second opening/closing velocity V2 of the throttle valve so as to rotate the throttle motor. FIG. 11 is a flow chart of a second embodiment of the present invention based on the foregoing control procedure.

Figure 5:
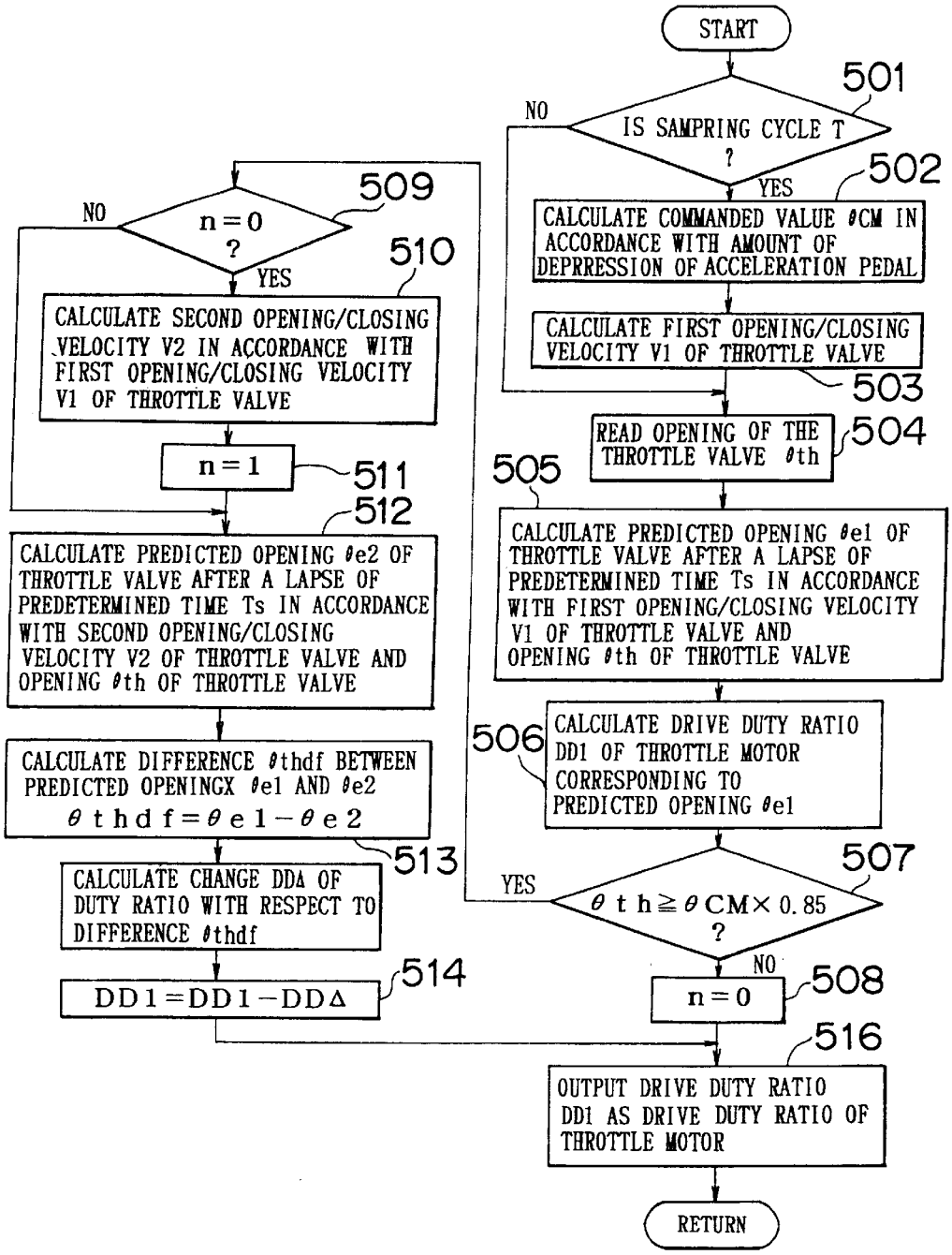
FIG. 5 is a flow chart of an example of a control procedure of a throttle valve for the control unit according to the present invention.

The control procedure shown in FIG. 11 is similar to the control procedure shown in FIG. 5 except for a portion. The similar portions are given the same step numbers to those shown in FIG. 5 and the description thereof will be omitted.

Steps 501 to 505 are the same as those of the procedure shown in FIG. 5. In step 501, it is determined whether or not the present time is sampling cycle T. In step 502, the commanded value θCM of the opening of the throttle valve is calculated in accordance with the present amount of depression of the acceleration pedal. In step 503, the first opening/closing velocity V1 is calculated. In step 504, the present opening θth of the throttle valve 3 is read. In step 505, predicted opening θe1 of the throttle valve after a lapse of a predetermined time (sampling cycle) Ts is calculated.

In the control shown in FIG. 5, the drive duty ratio DD1 of the throttle motor 4 corresponding to the predicted opening θe1 of the throttle valve is calculated in step 506. In this embodiment, step 507 is performed after step 505 has been completed so that it is determined whether or not the opening θth of the throttle valve 3 is about 85% of the commanded value θCM of the opening of the throttle valve.

If θth <θCM×0.85 in step 507, the flag n is made to be zero in step 508. Then, step 601 corresponding to step 506 in the control shown in FIG. 5 is performed. That is, in step 601, the drive duty ratio DD1 corresponding to the predicted opening θe1 is calculated. In step 516, the drive duty ratio DD1 calculated in step 601 is output as the drive duty ratio of the throttle motor 4. Thus, the foregoing routine is completed.

The procedure which is performed from steps 509 to 512 when θth≥θCM×0.85 in step 507 are the same as those described in the procedure shown in FIG. 5. In step 509, it is determined whether or not θth≥θCM×0.85 has been first satisfied in step 507. In step 510, the second opening/closing velocity V2 of the throttle valve is calculated in accordance with the first opening/closing velocity V1 of the throttle valve. In step 511, the value of the flag n is made to be 1. In step 512 the predicted opening θe2 of the throttle valve after a lapse of a predetermined time (sampling cycle) Ts is calculated.

In step 602, the drive duty ratio DD1 of the throttle motor corresponding to the predicted opening θe2 is calculated. The operation proceeds to step 516 where the drive duty ratio DD1 of the throttle valve is output as the drive duty ratio of the throttle motor 4. Thus, the foregoing routine is completed.

In this embodiment, after θth≥θCM×0.85 has been satisfied in step 507, the drive duty ratio DD1 output in step 516 is the drive duty ratio DD1 of the throttle motor 4 corresponding to the predicted opening θe2 of the throttle valve calculated in step 602. The foregoing value is the same as the value of the drive duty ratio DD1 corrected in step 515 in the control shown in FIG. 5. Therefore, also this embodiment causes the throttle motor to be rotated similar to the control shown in FIG. 5.

As described above, according to the present invention, control of the operation of the throttle valve is performed while predicting the drive duty ratio of the throttle motor. Therefore, prediction of the time taken for the throttle valve to reach a commanded value after the commanded value has been changed can be performed. As a result, the air fuel ratio can accurately be controlled. Therefore, emission of the engine can be reduced. Hitherto, the operation of the throttle valve cannot be detected when the engine side controls the air fuel ratio. The present invention enables the operation of the throttle valve to somewhat detected. Therefore, an amount of admitted air can be detected in accordance with the opening of the throttle valve after a lapse of a predetermined time. Therefore, corresponding fuel injection can be performed. As a result, the emission of the engine can be improved.

The electronically controlled throttle valve unit 30 is arranged to prevent stall of the engine when control has failed and maintain an amount of air required for the engine. To achieve this, a state in which the throttle valve 3 is opened by a predetermined opening is maintained even after the accelerator pedal 14 has been returned. The foregoing opening of the throttle valve 3 is called the opener opening. The foregoing opening is usually set by an opener opening setting mechanism having springs for urging the throttle valve 3 in the opening direction and the closing direction, respectively.

Figure 12A:
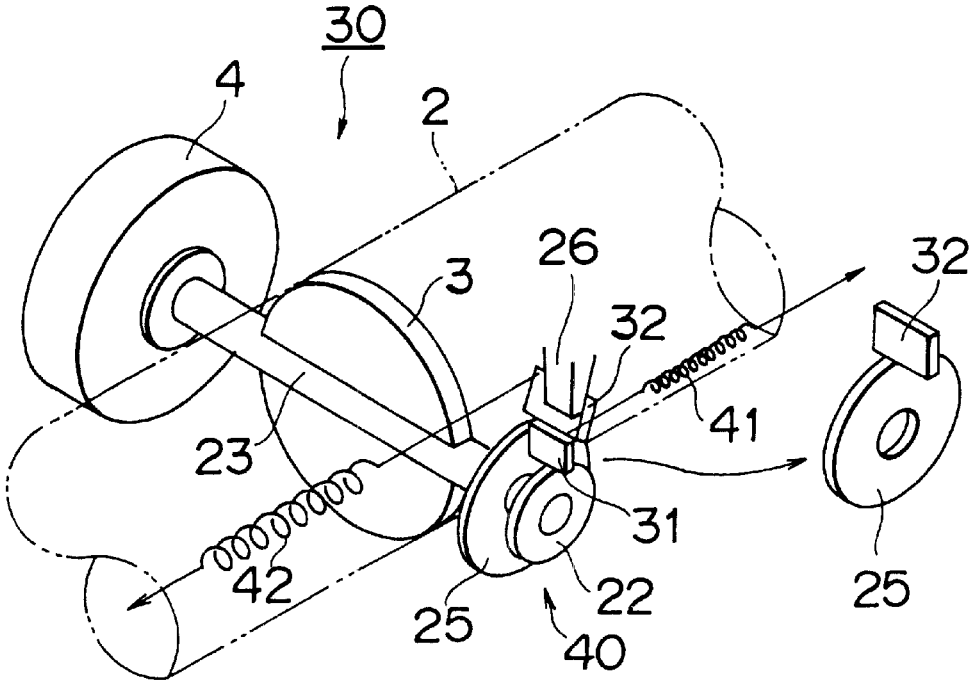
FIG. 12A is a perspective view showing a mechanism for setting opener opening of the electronically controlled throttle.
Figure 12B:
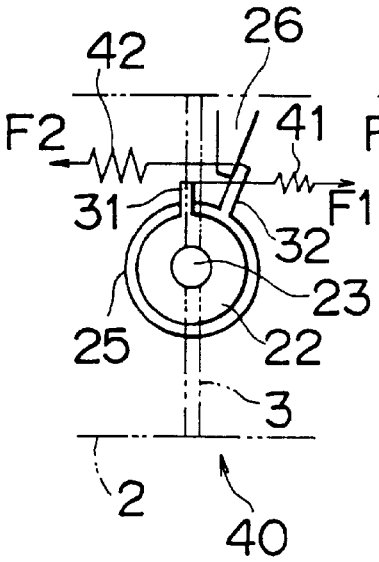
FIG. 12B is a diagram showing the operation of the mechanism shown in FIG. 12A.
Figure 12C:
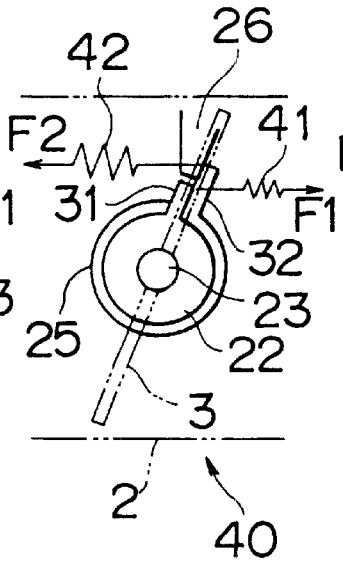
FIG. 12C is a diagram showing the operation of the mechanism shown in FIG. 12A.
Figure 12D:
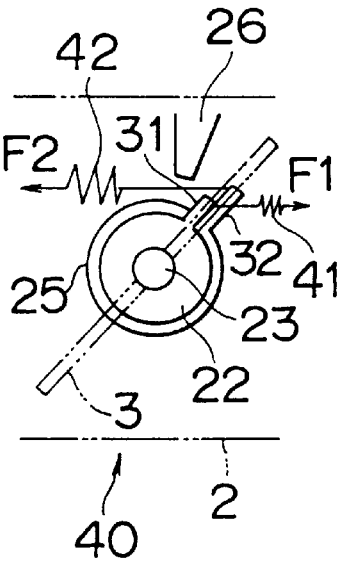
FIG. 12D is a diagram showing the operation of the mechanism shown in FIG. 12A.

FIG. 12A shows an example of the opener opening setting mechanism 40 of the electronically controlled throttle valve unit 30 from which an accelerator cable disposed between the accelerator pedal 14 and the throttle valve 3 has been omitted. The opener opening setting mechanism 40 urges the throttle valve 3 in the opening direction and the closing direction. FIGS. 12B to 12D show the operation of the opener opening setting mechanism 40. Note that the throttle opening sensor is omitted from FIG. 12A.

As shown in FIG. 12A, the throttle motor 4 for rotating a rotational shaft 23 of the throttle valve 3 provided for the suction passage 2 is disposed at the end of the rotational shaft 23. A flange 22 is secured to another end of the rotational shaft 23. A first movable member 31 is provided for a predetermined position of the outer surface of the flange 22. A first spring 41 is arranged between the first movable member 31 and a throttle body (not shown) of the electronically controlled throttle valve unit 30. The first spring 41 urges the first movable member 31 in the direction in which the throttle valve 3 is opened.

A movable ring 25 permitted to rotate around the rotational shaft 23 is fitted to the rotational shaft 23 adjacent to the flange 22. A second movable member 32 arranged to be engaged to the first movable member 31 owning to the rotation of the movable ring 25 is provided for the outer surface of the movable ring 25. A second spring 42 is arranged between the second movable member 32 and the throttle body (not shown) of the electronically controlled throttle valve unit 30. The second spring 42 urges the second movable member 32 in the direction in which the throttle valve 3 is opened. In this embodiment, the urging force of the second spring 42 is set to be larger than that of the first spring 41.

In addition to the foregoing structure, a stopper 26 for stopping the rotation of the second spring 42 is provided for the throttle body. The stopper 26 prevents exertion of the urging force of the second spring 42 on the throttle valve 3, the opening of which is smaller than the opener opening. The stopper 26 does not exert the influence on the operation of the first movable member 31.

The position of the flange 22 of the first movable member 31 and the relationship between the position of the second movable member 32 and the stopper 26 will now be described with reference to FIG. 12C. FIG. 12C shows the state in which the throttle valve 3 is opened at the opener opening. At this time, the second movable member 32 urged by the second spring 42 to rotate the throttle valve 3 in the opening direction is brought into contact with the stopper 26. Thus, the rotation of the second movable member 32 is interrupted. If the rotating force of a throttle motor (not shown) is not added to the rotational shaft 23 of the throttle valve in the foregoing state, the first movable member 31 is pulled by the first spring 41 so as to be brought into contact with the second movable member 32. As described above, the urging force of the first spring 41 is smaller than that of the second spring 42. Therefore, the throttle valve 3 maintains the opener opening in the state in which the rotating force of the throttle motor is not exerted on the rotational shaft 23.

FIG. 12B shows the state in which the throttle valve 3 has completely closed the suction passage 2.

To close the throttle valve 3 from the opener opening to the completely closed state, the throttle motor is required to be rotated to exert rotating force larger than urging force F1 of the first spring 41 on the rotational shaft 23. Note a stopper (not shown) provided individually stops the rotation of the throttle valve 3 at the completely closed state. Therefore, the opening of the throttle valve 3 is not made to be a negative opening.

FIG. 12D shows the state in which the throttle valve 3 has been opened at a predetermined opening which is larger than the opener opening. Both of the urging force F1 in a direction in which the throttle valve 3 is opened by the first spring 41 and urging force F2 in the direction in which the throttle valve 3 is opened by the second spring 42 are exerted on the first movable member 31 when the opening of the throttle valve 3 is larger than the opener opening. As described above, the urging force F1 of the first spring 41 is smaller than the urging force F2 of the second spring 42. Therefore, urging force (F2–F1) obtained by subtracting the urging force F1 of the first spring 41 from the urging force F2 of the second spring 42 is exerted on the first movable member 31. That is, urging force (F2–F1) in the direction in which the throttle valve 3 is closed is exerted on the first movable member 31. To enlarge the opening of the throttle valve 3, rotating force larger than the urging force (F2–F1) may be exerted from the throttle motor to the rotational shaft 23.

A case will now be described in which the electronically controlled throttle valve unit from which the accelerator cable arranged between the acceleration pedal and the throttle valve has been omitted is provided with the foregoing opener opening setting mechanism. When the throttle valve, which is completely closed, is operated in the direction in which the throttle valve is opened, the spring constant which acts on the rotational shaft of the throttle valve is changed in the vicinity of the opener opening at which the two springs are balanced. Therefore, the rotating force of the throttle motor for operating the throttle valve is changed. As a result, the throttle valve cannot smoothly be operated in the vicinity of the opener opening.

Figure 13:
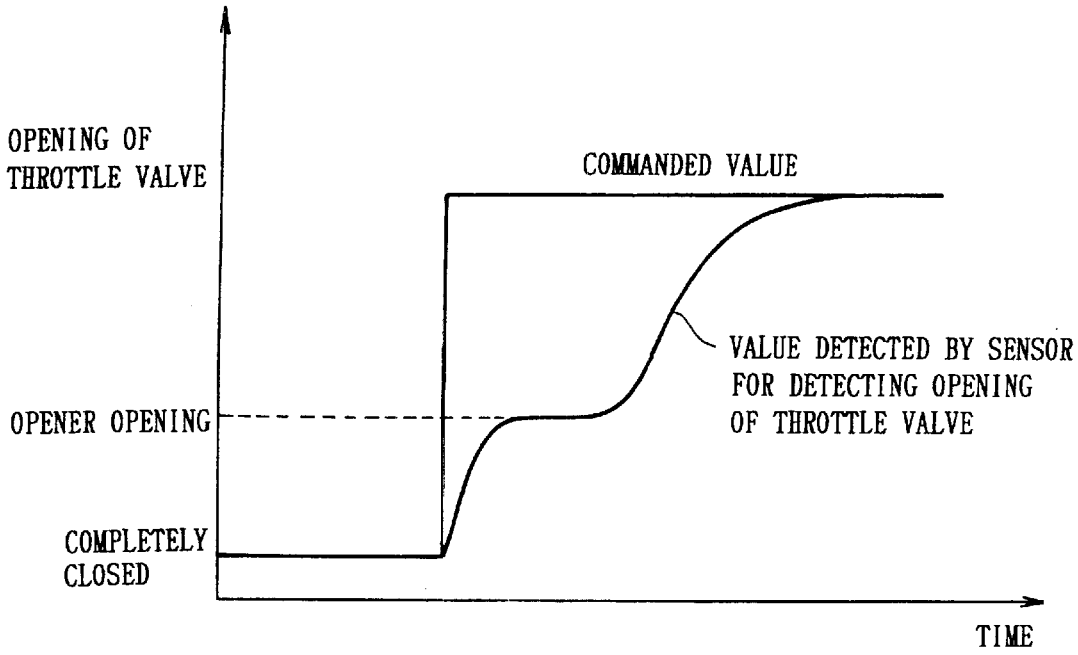
FIG. 13 is a characteristic graph showing problems experienced with the electronically controlled throttle shown in FIG. 12A.

A case will now be considered in which a command value for opening the throttle valve for a predetermined angular degree has been output from the unit for controlling the electronically controlled throttle valve in a state in which the throttle valve is completely closed as shown in FIG. 13. In the foregoing case, the opening of the throttle valve stagnates for a certain period of time in the vicinity of the opener opening. Therefore, the throttle valve cannot smoothly be operated. Also in a case where the throttle valve is controlled from the opening position to the closing position across the opener opening, the throttle valve cannot smoothly be operated.

A portion of the throttle motors for operating the electrically controlled throttle valve is able to uniformly generate torque over the full operation range of the engine. A portion of the throttle motors cannot perform the above-mentioned operation. When the motor which is capable of uniformly generating torque over the full operation range of the engine is adapted to the electrically controlled throttle valve, the torque for operating the throttle valve is sometimes insufficient owning to the environment for the operation. Therefore, the throttle valve cannot sometimes be operated in a smooth manner even at an angle except for the angle in the vicinity of the opener opening.

Accordingly, the next embodiment is arranged to be capable of smoothly opening/closing the throttle valve even if the throttle valve is operated in the opening or closing direction across the opener opening or if the throttle valve cannot smoothly be operated at an opening except for the opener opening.

This embodiment is structured such that the opener opening setting mechanism 40 (not shown) for setting the opening of the throttle valve 3 is added to the structure shown in FIG. 2, which is disposed at the end of the rotational shaft of the throttle valve 3.

Figure 14:
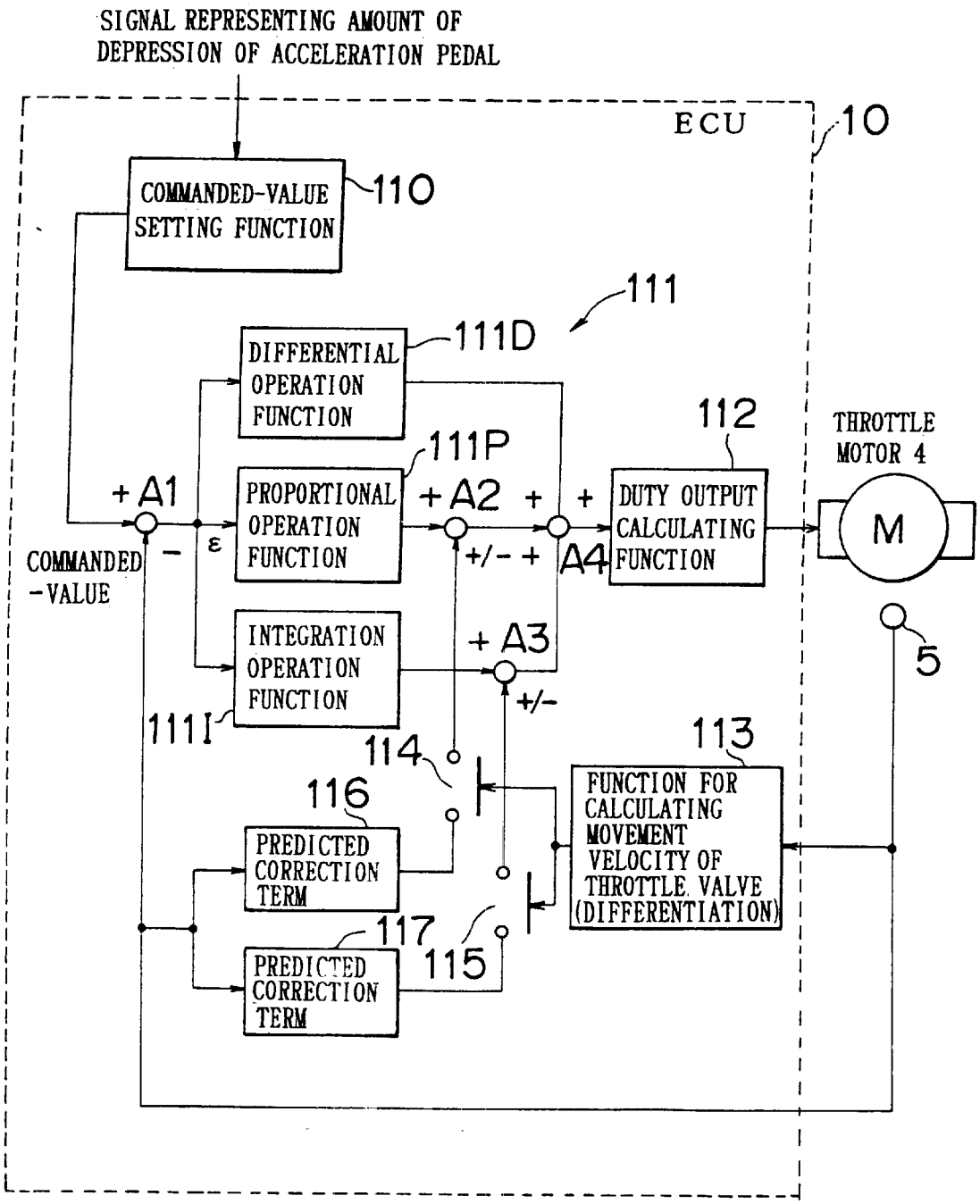
FIG. 14 is a block diagram showing a control operation according to a third embodiment of the present invention.

FIG. 14 is a block diagram showing the functions of the ECU 10 for realizing a third embodiment. When the signal representing the amount of depression of the acceleration pedal has been input to the ECU 10, the commanded-value setting function 110 produces a commanded value at each predetermined time T, as described above. The commanded value is supplied to the PID control function 111 incorporating the differential operation function 111D, the proportional operation function 111P and the integration operation function 111I. In accordance with the foregoing commanded value, the PID control function 111 calculates the opening/closing velocity of the throttle valve. Moreover, the PID control function 111 outputs a target value of the opening of the throttle valve which is determined by the opening/closing velocity of the throttle valve. The target value of the opening of the throttle valve is supplied to the duty output calculating function 112. The duty output calculating function 112 calculates a duty ratio of an operating signal for the throttle motor in accordance with the target value of the opening of the throttle valve. The duty ratio of the operating signal for the throttle motor 4 is output to the throttle motor 4. Thus, the throttle motor 4 is rotated so that the opening of the throttle valve is changed. The opening of the throttle valve is detected by the throttle opening sensor 5. The sign of a value detected by the throttle opening sensor 5 is inverted, and then added to the commanded value by an adding function A1 so as to be fed back to the PID control function 111.

The corresponding system for the usual throttle valve has the foregoing functions. In this embodiment, the foregoing control system further incorporates a function (a differentiating function) 113 for calculating the movement velocity of the throttle valve, two switches 114 and 115 which are switched on/off by the function 113 for calculating the movement velocity of the throttle valve, a function 116 for calculating a predicted correcting term of the proportional operation, a function 117 for calculating a predicted correction term of the integration operation, and addition functions A2 and A3 for adding predicted correction terms of the predicted correction term of the proportional operation and the predicted correction term of the integration operation. The function 113 for calculating the movement velocity of the throttle valve detects the movement velocity of the throttle valve in accordance with the value detected by the throttle opening sensor 5 in a unit time. When the movement velocity of the throttle valve is lower than a predetermined value, the function 113 for calculating the movement velocity of the throttle valve switches the switches 114, 115 on. The function 116 for calculating a predicted correction term of the proportional operation and the function 117 for calculating a predicted correction term of the integration operation calculate the proportional operation and the integration operation, respectively, in accordance with a value detected by the throttle opening sensor 5. The predicted correction term calculated by the function 116 for calculating a predicted correction term of the proportional operation is, through the switch 114, output to the addition function A2 disposed between the proportional operation function 111P and the duty output calculating function 112. The predicted correction term calculated by the function 117 for calculating a predicted correction term of the integration operation is, through the switch 115, output to the addition function A3 disposed between the integration operation function 111I and the duty output calculating function 112.

Note that the two switches 114 and 115 are not mechanical switches and the foregoing switches are flags for operating the predicted correction terms 116 and 117.

Figure 15A:
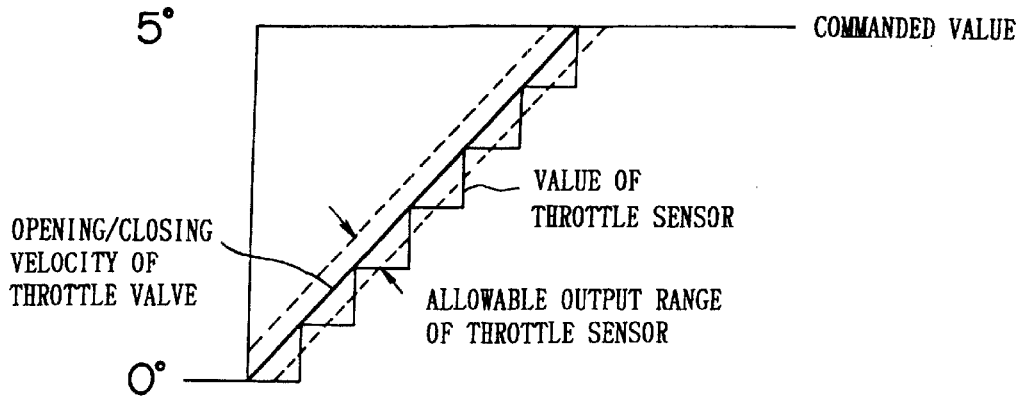
FIG. 15A is a graph showing an example of the characteristic of opening/closing velocity of the throttle valve in accordance with a commanded value for the throttle valve.

A case of the unit for controlling the electronically controlled throttle valve structured as shown in FIG. 14 will now be considered. This case is the case in which the opening/closing velocity of the throttle valve is set and the opening of the throttle valve is caused to follow up the set opening after a commanded value of a predetermined opening, for example, an opening of 5° is output. The relationship between the opening of the throttle valve and an actual value detected by the throttle opening sensor (expressed as throttle sensor in the drawing) will now be described in the case were the throttle valve has smoothly followed the opening/closing velocity of the throttle valve. The opening/closing velocity of the throttle valve with respect to the commanded value is sometimes the same until the opening of the throttle valve reaches the commanded value. In some cases, the foregoing opening/closing velocity is changed before the opening of the throttle valve reaches the commanded value FIG. 15A shows the case in which the opening/closing velocity of the throttle valve with respect to the commanded value is constant until the opening of the throttle valve reaches the commanded value. When the commanded value has been set to the opening of 5°, the opening/closing velocity of a predetermined throttle valve is set as indicated with a thick line. Thus, the throttle valve is operated to follow up the opening/closing velocity at t. At this time, the value of the throttle sensor is read at each time Ts. The foregoing case is the case in which the throttle valve has smoothly followed up the opening/closing velocity of the throttle valve. Therefore, output values of the throttle sensor follow the opening/closing velocity of the throttle valve and, therefore, the values are changed stepwise. In the foregoing case, an allowable range indicated with dashed lines is provided for the opening/closing velocity of the throttle valve. If the output value of the throttle sensor is deviated from the foregoing range, the predicted correction terms 116 and 117 shown in FIG. 14 are operated.

Figure 15B:
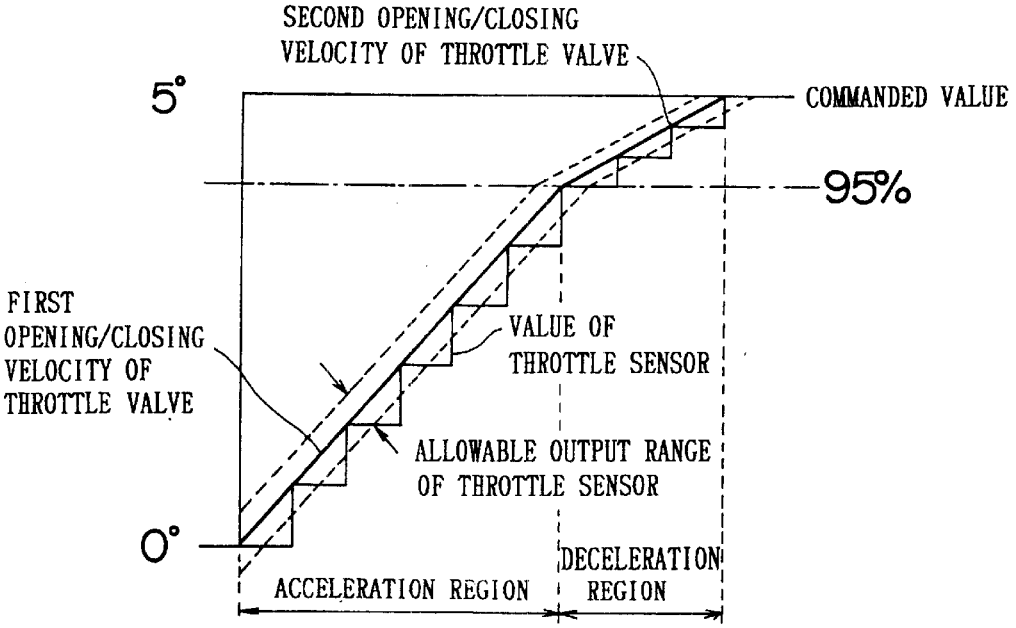
FIG. 15B is a graph showing another example of the characteristic of the opening/closing velocity of the throttle valve in accordance with a commanded value for the throttle valve.

FIG. 15B shows the case in which a plurality of opening/closing velocities of the throttle valve with respect to a commanded value exist until the opening of the throttle valve reaches the commanded value. When the commanded value has been set to the opening of 5°, a region for accelerating the throttle valve which is 95% of 5° and a region for decelerating the throttle valve which is 95% to 100% are set. As indicated with a thick line, a first opening/closing velocity of the throttle valve is set in the acceleration region. In the deceleration region, a second opening/closing velocity which is lower than the first opening/closing velocity is set. The throttle valve is operated to follow the first and second opening/closing velocity. At this time, the value of the throttle sensor is read at each time Ts. The foregoing case is a case in which the throttle valve has smoothly followed the opening/closing velocity of the throttle valve. Therefore, the output value from the throttle sensor follows the first and second opening/closing velocities and, therefore, the value is changed stepwise. Also in the foregoing case, allowable ranges for the output value from the throttle sensor indicated with dashed lines are provided for the first and second opening/closing velocities. Therefore, also in the foregoing case, if the output value from the throttle sensor is deviated from the foregoing ranges, the predicted correction terms 116 and 117 shown in FIG. 14 are operated.

After the output value of the throttle sensor has temporarily been deviated from the foregoing range, the predicted correction terms 116 and 117 shown in FIG. 14 are operated when the deviation between the previous output of the throttle sensor and the present output is smaller than a reference value. The reference value is required to be half of the foregoing allowable range. When the deviation between the previous output of the throttle sensor and the present output is larger than the reference value after the output vale of the throttle sensor has temporarily be deviated from the foregoing range, the operations of the predicted correction terms 116 and 117 shown in FIG. 14 are required to instantaneously stopped or gradually moderated.

Figure 16:
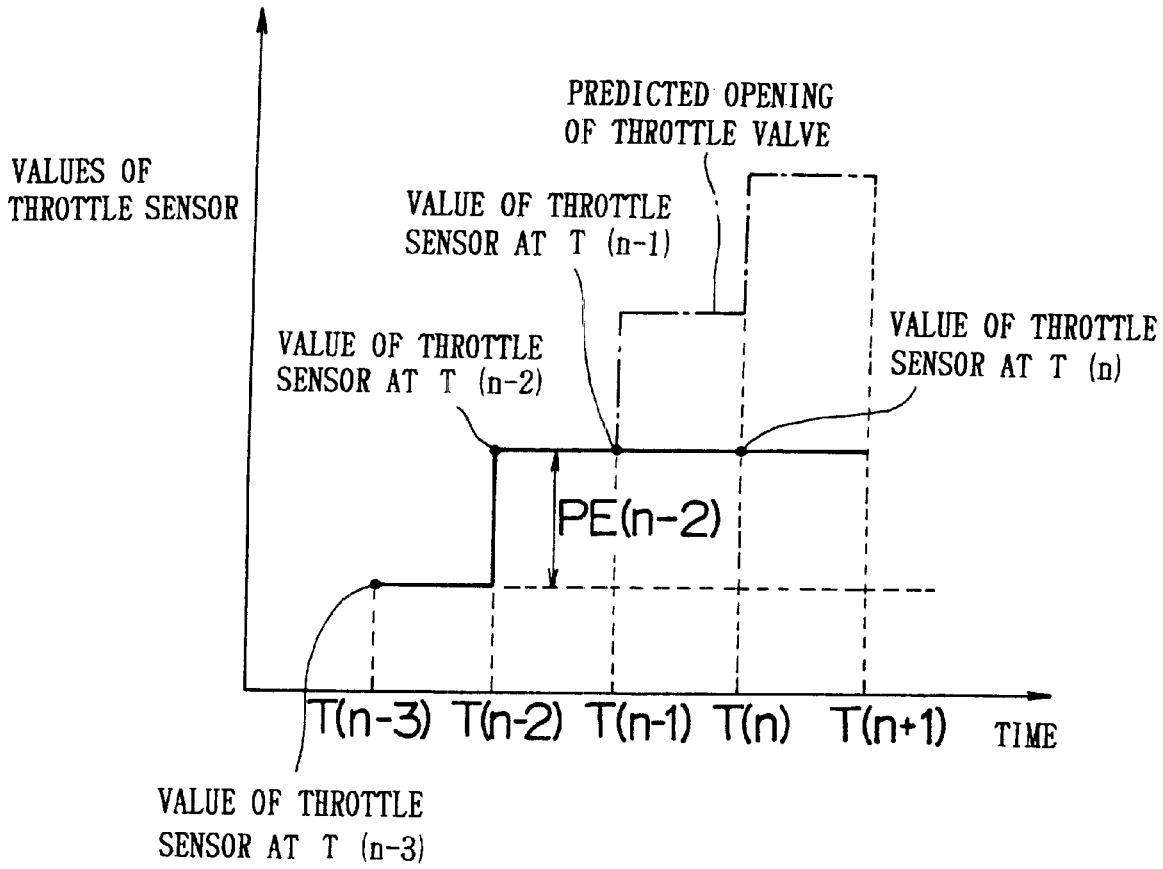
FIG. 16 is a graph showing waveforms indicating transition of the predicted opening of the throttle valve according to the present invention in a case change in the value of a throttle sensor is abnormal.

FIG. 16 shows the case in which the operations of the predicted correction terms 116 and 117 shown in FIG. 14 which are performed when the output value of the throttle sensor has been deviated from the allowable ranges shown in FIG. 15A and 15B. In this case, output difference PE (n−2) satisfying the foregoing allowable range or larger than the reference value exists between the value of the throttle sensor at time T (n−3) and that of the throttle sensor at time T (n−2). Moreover, no output difference exists between the value of the throttle sensor at time T (n−2) and that of the throttle sensor at time T (n−1). In addition, also no output difference exists between the value of the throttle sensor at time T (n−1) and that of the throttle sensor at time T (n).

In the foregoing case, the predicted correction terms 116 and 117 shown in FIG. 14 calculate predicted correction terms at time T (n−1) and time T (n). Thus, the throttle valve is operated on the assumption that the predicted opening of the throttle valve as indicated with an alternate long and short dash line has been obtained from the throttle sensor. The predicted opening of the throttle valve is the same as the output difference PE (n−2) between the value of the throttle sensor at time T (n−3) and that of the throttle sensor at time T (n−2).

That is, the deviation PE (n−2) between the opening of the throttle valve at the previous time T (n−3) and the present opening of the throttle valve is calculated at time T (n−2).

The deviation PE (n−2) is stored as a predicted value of the opening of the throttle valve at the next time T (n−1). If a fact is detected at time T (n−1) that no deviation exists between the present and previous openings of the throttle valve, the detected opening of the throttle valve at time T (n−1) is made to be a value obtained by adding the deviation PE (n−2) calculated at the previous time T (n−2) to the opening of the throttle valve at time T (n−2).

Figure 17:
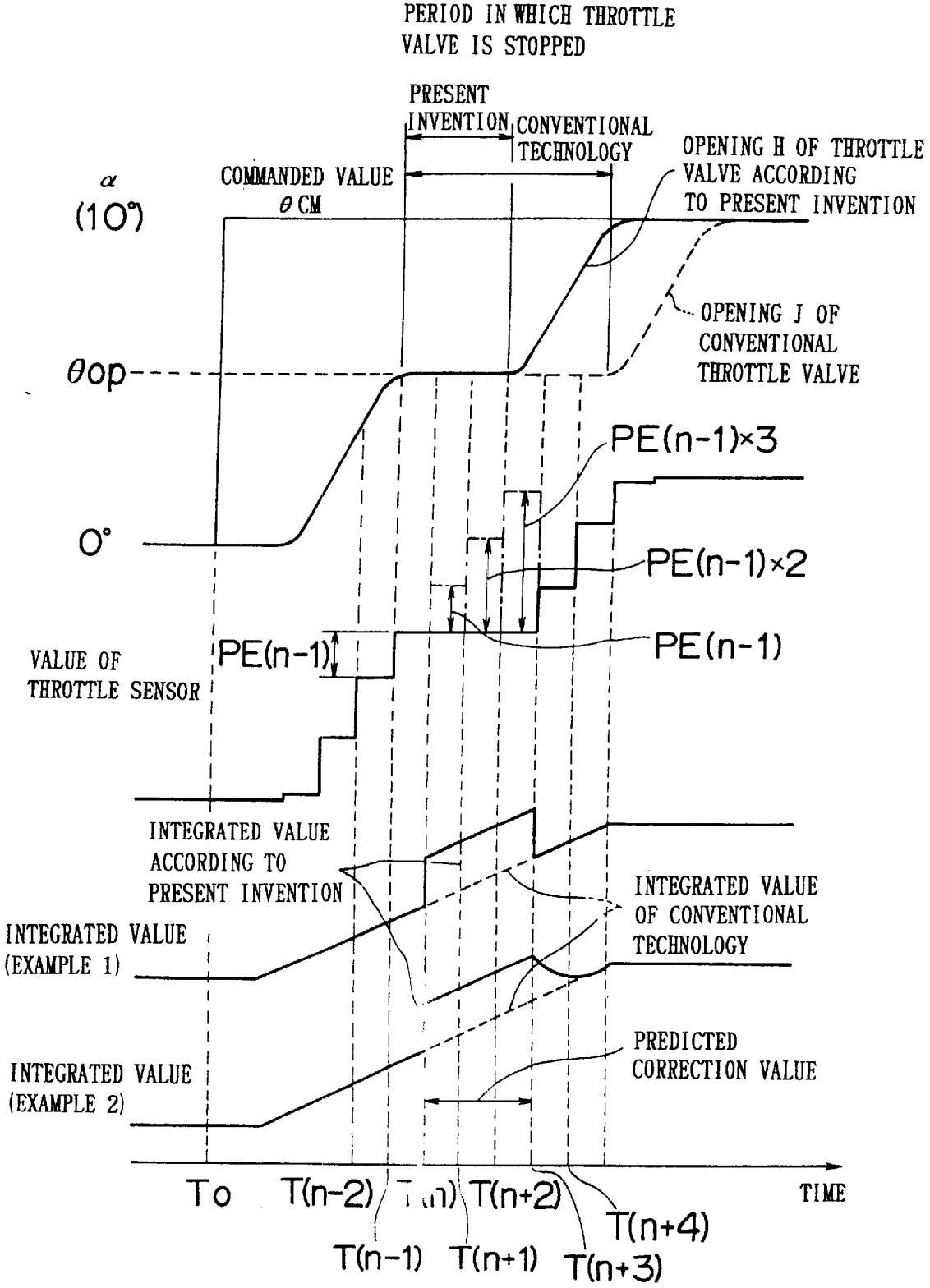
FIG. 17 is a time chart showing a state of change in the commanded opening of the throttle valve when the throttle valve is opened, the opening according to the present invention and that according to the conventional structure, the values of the throttle sensor and the integrated values in the PID control.

FIG. 17 is a time chart showing transition of the commanded value θCM, that of opening of the throttle valve of each of the present invention and the conventional structure, that of the value of the throttle sensor and that of the integrated value (examples 1 and 2) realized when a commanded value θCM of an opening α, for example, 10° has been output at time To. It is assumed that the opening of the throttle valve before time To is 0° (in a completely closed state). In the foregoing case, the opening of the throttle valve passes the opener opening θop to reach the commanded opening α after the commanded value θCM of the opening α has been output.

As can be understood from FIG. 17, when the opening of the throttle valve has been enlarged in accordance with the commanded value θCM followed by the opening of the throttle valve reaches the opener opening θop at time T(n−1), the conventional structure encounters a stoppage period for the throttle valve until time passes time T(n+4). The reason for this lies in that the integrated value is similar to that in the other periods in a period in which the value of the throttle sensor is not changed in a period from time T(n−1) to time T(n+3) in spite of change in the spring constant which acts on the rotational shaft of the throttle valve at the opener opening θop.

Therefore, when a fact that the value of the throttle sensor has not been changed from the value of the throttle sensor at time T(n−1) is detected at time T (n), the value of the throttle sensor at time T (n) is made as follows. That is, as indicated with an alternative long and short dash line, the value of the throttle sensor is the predicted value obtained by adding the deviation PE (n−1) of the value of the throttle sensor at time T (n−1) to the previous value of the throttle sensor. When a fact that the value of the throttle sensor has not been changed from the value of the throttle sensor at time T (n) is detected at time T(n+1), the value of the throttle sensor at time T(n+1) is made as follows. That is, an indicated with an alternate long and short dash line, the value of the throttle sensor is a predicted value obtained by adding the deviation PE(n−1) of the value of the throttle sensor at time T(n−1) to the previous value of the throttle sensor. That is, the value of the throttle sensor is the value obtained by adding a value which is two times the deviation (PEn−1) of the value of the throttle sensor at time T(n−1) to the value of the throttle sensor at time T(n+1). When a fact that the value of the throttle sensor has not been changed from the value of the throttle sensor at time T(n+1) is detected at time T(n+2), the value of the throttle sensor at time T(n+2) is made as follows. That is, as indicated with an alternate long and short dash line, the value of the throttle sensor is a predicted value obtained by adding the deviation PE(n−1) of the value of the throttle sensor at time T(n−1) to the previous value of the throttle sensor. That is, the value of the throttle sensor is the value obtained by adding a value which is three times the deviation PE(n−1) of the value of the throttle sensor at time T(n−1) to the value of the throttle sensor at time T(n+2).

Figure 18:
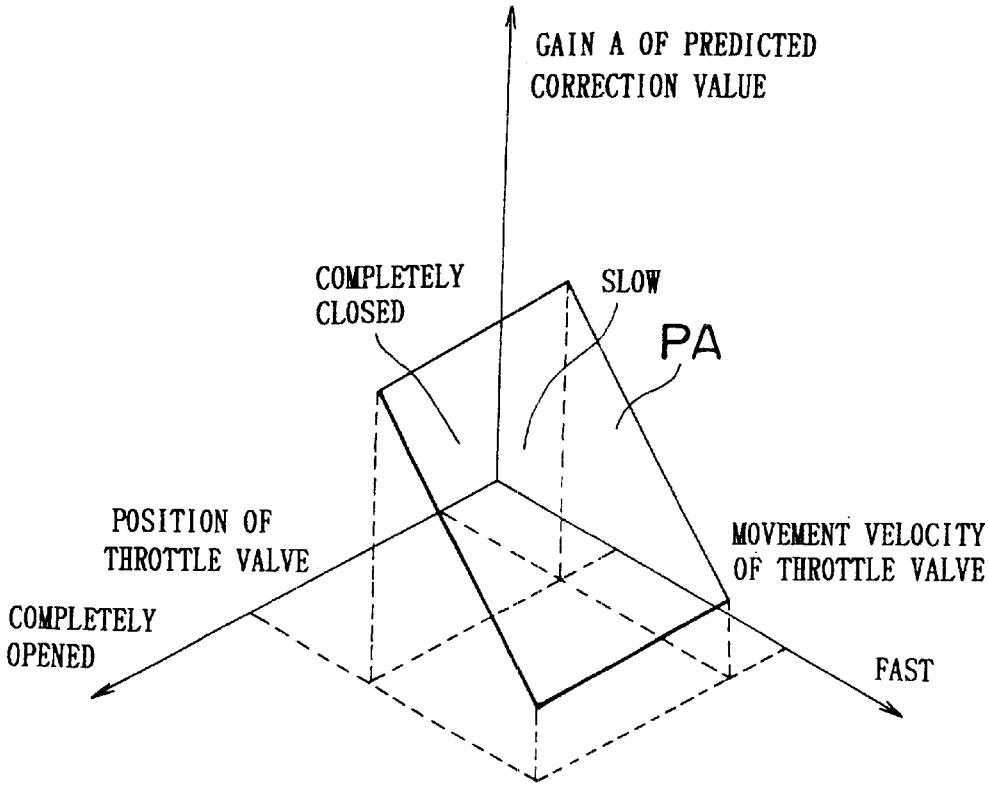
FIG. 18 is a two-dimensional map showing a method of obtaining the gain when a predicted correction value is calculated.

Predicted correction term Ya at time T (n) is calculated by the following Equation (1) in accordance with the predicted value of the throttle sensor at time T (n):

$$Ya=(PE(n-1\times N)\times gain\ A \quad (1)$$

where N is the number of times at which a fact that the deviation between the previous value and the previous value detected by the throttle sensor is not a normal value and therefore, N=1 at time T(n). The gain A of the predicted correction term Ya is detected as a point on a plane PA of a two-dimensional map as shown in FIG. 18 in accordance with the position of the throttle sensor and the movement velocity of the throttle valve.

Similarly, the predicted correction term Ya at time T(n+1) can be obtained by making N in the equation (1) to be 2 in accordance with the predicted value of the throttle sensor at time T(n). The predicted correction term Ya at time T (n+2) can be calculated by making N in the equation (1) to be 3 in accordance with the predicted value of the throttle sensor at time T(n).

At time T(n+3), the deviation between the value detected by the throttle sensor at time T(n+3) and the value detected by the throttle sensor at time T(n+2) is made to be larger than the foregoing reference value. Therefore, the value of the predicted correction term Ya is not calculated.

After the predicted correction term Ya has been calculated, the value of the proportional calculation and the value of the integrating calculation are corrected. Only the value of the integrating calculation will now be described. The value of the integrating calculation is calculated as the following equation (2) by using the predicted correction term Ya:

$$\text{Value of Integrating Calculation}=(\text{Deviation}\epsilon\times\text{Gain in Integration})+Ya \quad (2)$$

where deviation ϵ is the value in the rear of the adder A1 shown in FIG. 14. The value of the integrating operation corrected with equation (2) is positioned between time T(n) and time T(n+3) shown in FIG. 17 as indicated with a solid line. When the deviation between the value detected by the throttle sensor at time T(n+3) and that detected by the throttle sensor at time T (n+2) is made to be larger than the foregoing reference value, the value of the predicted correction term Ya is not calculated at time T(n+3). The value of the integrating operation is restored to the original state. At this time, either of methods may be employed which include the method with which the value of the integration is immediately restored to the original state as shown in example 1 of FIG. 17 and the method with which the value of the integration is gradually restored to the original state as shown in example 2.

Although the integrated value is corrected on the basis of a value of the predicted correction term Ya, also the differentiated value may similarly be corrected.

The PID control according to this embodiment is structured such that when the value detected by the throttle sensor is free from change that is larger than the reference value, the predicted correction term Ya is calculated to correct the value of the proportion and the value of the integration. Thus, this embodiment is able to change the operation characteristic of the throttle valve 3 at the opener opening θop. Therefore, the period of stoppage of the throttle valve 3 at the opener opening θop can be shortened as indicated with a solid line H shown in FIG. 17. On the other hand, the conventional and simple PID control undesirably encounters elongation of the period of stoppage of the opening of the throttle valve near the opener opening θop as indicated with a dashed line shown in FIG. 17. Therefore, the throttle valve 3 cannot smoothly be operated.

In the foregoing embodiment, the next predefined opening of the throttle valve is previously calculated in accordance with the previous opening of the throttle valve and the present opening of the throttle value. When the deviation between the previous opening of the throttle valve and the present opening of the throttle valve is smaller than the reference value K, the predicted opening of the throttle valve calculated previously is employed as the present opening of the throttle valve to correct the rotating force of the motor. As an alternative to this, a comparison may be made between the predicted opening of the throttle valve calculated previously and the present opening of the throttle valve. If the comparisons results in a fact that the deviation is larger than reference value M, the rotating force of the motor may be corrected in accordance with the deviation.

In the previous embodiment, the next predicted opening of the throttle valve is obtained in accordance with the deviation between the present opening of the throttle valve and the previous opening of the throttle valve. The next predicted opening of the throttle valve may be calculated by averaging the transition of the opening of the throttle valve which has occurred plural times.

The example shown in FIG. 17 is arranged to perform control when the engine is accelerated by the opening of the throttle valve is enlarged. The control which is performed when the engine is decelerated by reducing the opening of the throttle valve may be structured such that the control for the acceleration process is inverted vertically. Therefore, the description of the foregoing control is omitted.

An example of the control which is performed as described above by the control unit will now be described with reference to a flow chart shown in FIG. 19. The procedure shown in the foregoing flow chart is performed at each predetermined time Ts which is shorter than the sampling cycle T. The foregoing procedure controls the value of the integration as shown in example 1 of FIG. 17.

In step 701, it is determined whether or not the present time is the sampling period T. If the present time is the sampling period T, the operation proceeds to step 702 where a present opening (the amount of depression of the acceleration pedal) detected by the accelerator opening sensor 15 is read as shown in FIGS. 3A and 3B. The read opening is made to be a present commanded value θCM of the opening of the throttle valve. In step 703, opening/closing velocity V1 of the throttle valve is calculated. In accordance with the magnitude of the commanded value θCM. When, the operation proceeds to step 704.

The first opening/closing velocity V1 indicates a reference value for the following velocity of the opening of the throttle valve with respect to the commanded value θCM. The opening/closing velocity V1 is required to be formed into a map so as to be stored in the ROM 103 so as to be determined in accordance with the magnitude of the commanded value θCM at the time at which the opening/closing velocity V1 is calculated. Also the opening/closing velocity V1 of the throttle valve can be obtained by the present control. That is, also the opening/closing velocity V1 of the throttle valve can be obtained by producing a state equation by using parameters including the commanded value θCM, the amount of depression of the accelerator pedal, the voltage of a better and the temperature detected at the time at which the first opening/closing velocity V1 is calculated. Then the foregoing state equation is solved so that the opening/closing velocity V1 is obtained.

If it is determined in step 701 that the present time t1 is not the sampling period T, steps 702 and 703 are not performed. In this case, the operation proceeds to step 704.

In step 704, the previous opening of the throttle valve θtho is read. In step 705, the present opening of the throttle valve θth is read as the present value. In step 706, the deviation Δθth between the previous and present openings of the throttle valve is calculated. Moreover, the movement velocity Vth of the throttle valve is calculated.

In step 707, it is determined whether or not the absolute value of the deviation Δθth between the previous and present openings of the throttle valve calculated in step 706 is larger than the reference value K. If |Δθth|>K in step 707, the operation proceeds to step 708 where it is determined whether or not the movement velocity Vth of the throttle valve calculated in step 706 is larger than predetermined velocity L. If |Vth|>L in step 708, it is determined that the throttle valve has been smoothly followed the opening/closing velocity V1. Then, the operation proceeds to step 709. In step 709, on opening obtained by adding the deviation Δθth between the previous and present openings of the throttle valve calculated in step 706 to the present opening θthe of the throttle valve read in step 706 is made to be the next predicted opening θth of the throttle valve. Moreover, the present predicted opening θth of the throttle valve read in step 705 is stored as the previous opening θtho of the throttle valve. Then, the number N of times at which the fact has been detected that the deviation between the previous and present values detected by the throttle sensor has exceeded the allowable range or the same is smaller than the reference value K is made to be zero. Then, the operation proceeds to step 710. In step 710, the drive duty ratio of the throttle motor is calculated for the usual PID control so as to be output. Thus, the foregoing routine is completed.

If it is determined in step 707 that |Δθth|>K, or if it is determined in step 708 that |Vth|>L, the operation proceeds to step 711. In step 711, one is added to the number N of times at which the fact has been detected that the deviation between the previous detected value and the present detected value obtained by the throttle sensor has been made to be larger than the allowable range or a fact has been detected that the deviation has been smaller that the reference value K. Then, the operation proceeds to step 712. In step 712, the predicted opening θthe of the throttle valve calculated in the previous routine is read. In step 713, the number N calculated in step 711 and the predicted opening θthe of the throttle valve read in step 712 are used to calculate the predicted correction term Ya for the PID control in accordance with the foregoing equation (1). In step 714, the predicted correction term Ya is subjected to the PID control in which the foregoing equation (2) is considered so that the drive duty ratio for the throttle motor is calculated and output. Thus, the foregoing routine is completed.

Figure 20:
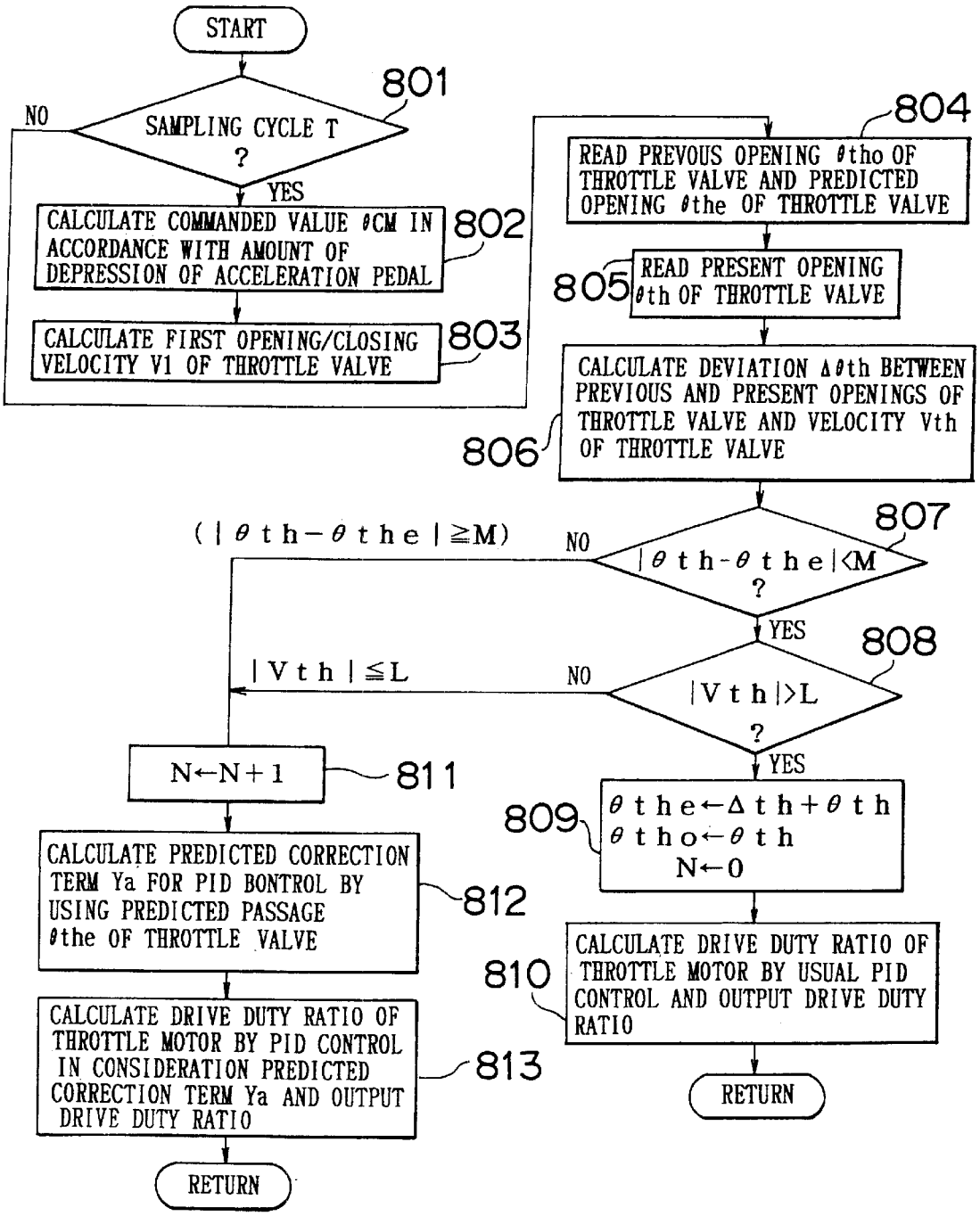
FIG. 20 is a flow chart showing another example of a procedure for controlling the throttle valve.

The foregoing control is structured such that the next predicted opening of the throttle valve is previously calculated in accordance with the previous opening of the throttle valve and the present opening of the throttle valve. If the deviation between the previous opening of the throttle valve and the present opening of the throttle valve is not larger than the reference value K, the predicted opening of the throttle valve calculated previously is employed as the present opening of the throttle valve to correct the rotating force of the motor. Then, the procedure will now be described with reference to FIG. 20. The procedure is structured such that the predicted opening of the throttle valve calculated previously and the present opening of the throttle valve are compared with each other. If the comparison results in that the deviation between the two values is not smaller than the reference value M, the rotating force of the motor is corrected in accordance with the deviation.

Figure 19:
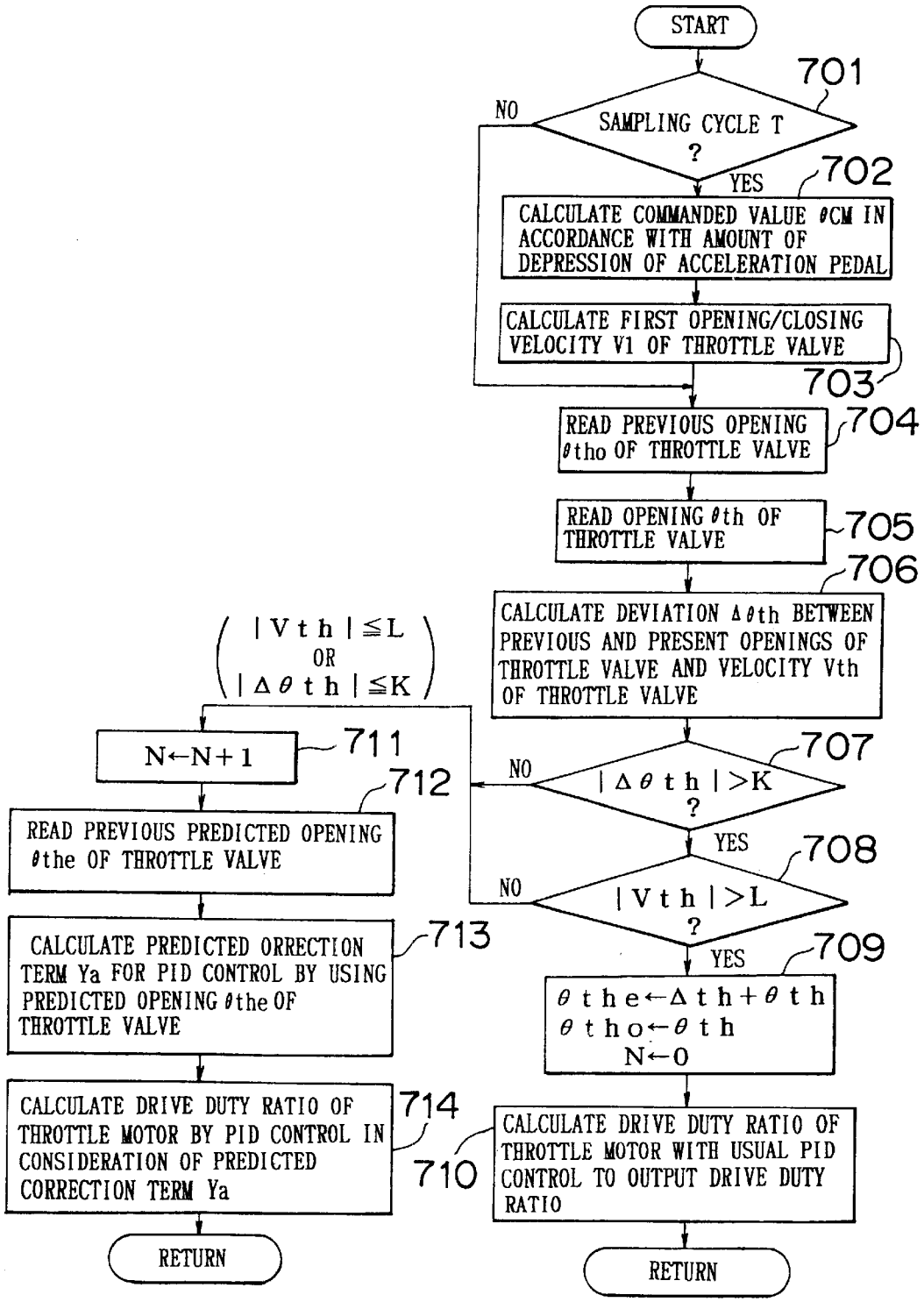
FIG. 19 is a flow chart showing an example of a procedure for controlling the throttle valve.

Steps 801 to 803 are the same as steps 701 to 703 shown in FIG. 19. Only when the present time is the sampling cycle T, the present amount of depression of the acceleration pedal is read to make the amount as the commanded value θCM of the present opening of the throttle valve. In accordance with the magnitude of the commanded value θCM, the opening/closing velocity V1 of the throttle valve is calculated. Then, the operation proceeds to step 804.

In step 804, the previous opening θtho of the throttle valve and the predicted opening θth of the throttle valve calculated previously are read. In step 805, the present opening θth of the throttle valve is read as the present value. In step 806, the deviation Δθth between the previous and present openings of the throttle valve is calculated. Moreover, the movement velocity Vth of the throttle valve is calculated.

In step 807, it is determined whether or not the absolute value |θth−θthe| of the deviation between the present opening θth of the throttle valve read in step 805 and predicted opening θthe read in step 804 and calculated previously is smaller than the reference value M. If |θth−θthe|<M in step 807, the operation proceeds to step 808 where it is determined whether or not the movement speed Vth or the throttle valve calculated in step 806 is larger than the predetermined velocity L. If |Vth|>L in step 808, it is determined that the throttle valve smoothly follows the opening/closing velocity V1 of the throttle valve. Thus, the operation proceeds to step 809. Steps 809 and 810 are the same as steps 709 and 710. In step 809, an opening obtained by adding the deviation Δθth between the previous and present openings of the throttle valve to the present opening θth of the throttle valve is made to be a next predicted opening θthe of the throttle valve. Moreover, the present opening θth of the throttle valve is stored as the previous opening θtho of the throttle valve. The number N of the abnormal conditions is made to be zero. Then, a usual PID control is performed in step 810 so that the drive duty ratio for the throttle motor is calculated and output. Thus, the foregoing routine is completed.

If it is determined in step 807 that |θth−θthe|≧M, or if it is determined in step 808 that |Vth|>L, the operation proceeds to step 811. In step 811, one is added to the number N of times at which the fact has been detected that the deviation between the present value detected by the throttle sensor and the present predicted opening of the throttle valve has been not smaller than the reference value M. Then, the operation proceeds to step 812. In step 812, the value of the number N of times calculated in step 811 and the predicted opening θth of the throttle valve read in step 804 are used so that the predicted correction term Ya for the PID control is calculated in accordance with the following equation (3) which is similar to the foregoing equation (1):

$$Ya=((\theta the-\theta tho)\times N)\times gain\ A \quad (3)$$

In step 813, the PID control is performed such that the predicted correction term Ya is considered with the equation (2) so that the drive duty ratio of the throttle motor is calculated and output. Thus, the foregoing routine is completed.

Figure 21:
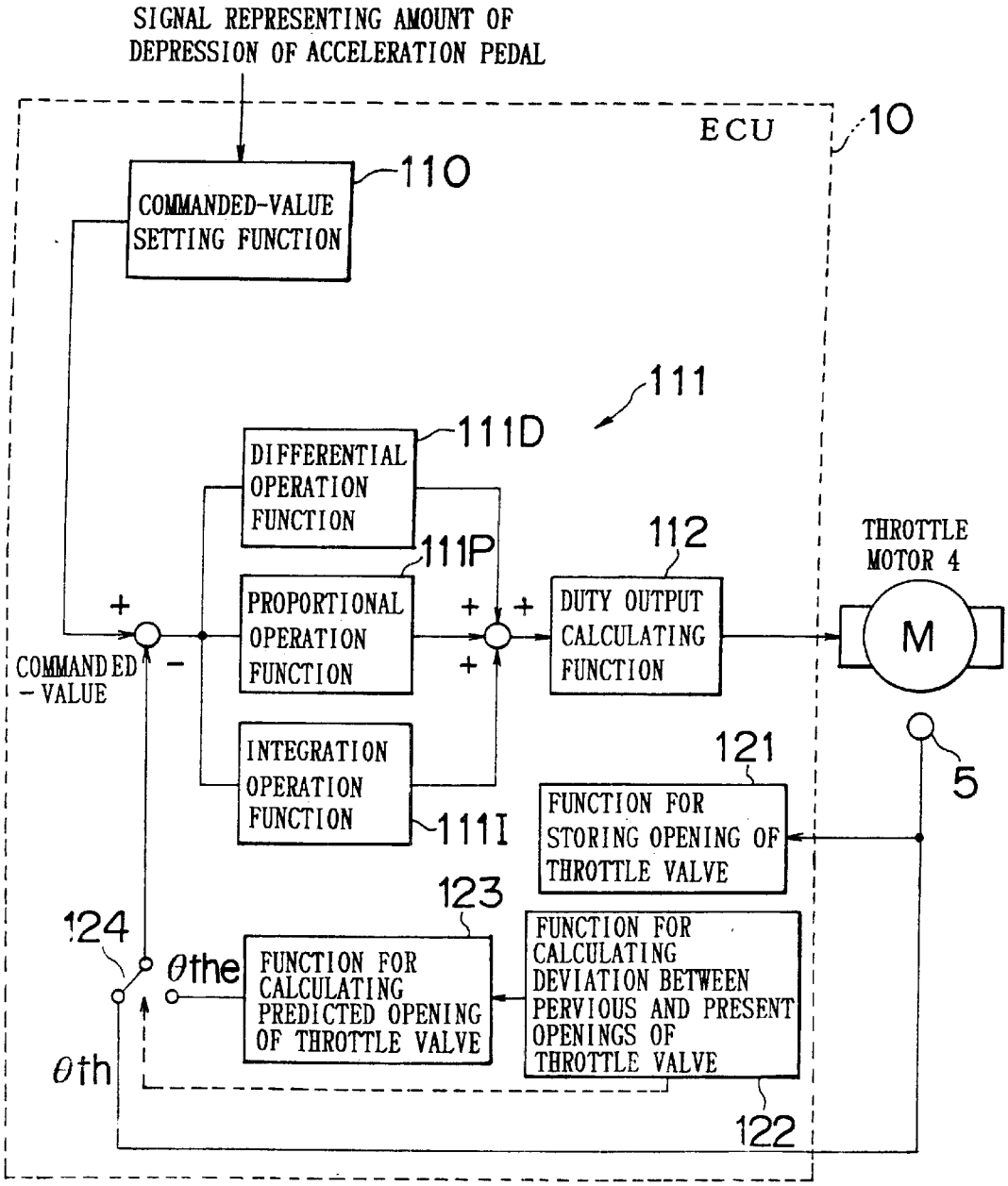
FIG. 21 is a block diagram showing a control operation according to a fourth embodiment of the present invention.

FIG. 21 is a block diagram showing functions of the ECU 10 shown in FIG. 2 to realize a fourth embodiment. The following arrangements are the same as those shown in FIG. 14. The structure of the PID control function 111 of the ECU 10 incorporates the differential operation function 111D, the proportional operation function 111P and integration operation function 111I, the structure of the duty output calculating function 112, and the structure that the opening of the throttle valve which is operated by the throttle motor 4 is detected by the throttle opening sensor 5 so as to be fed back to the PID control function 111. Therefore, illustration of the same portions will be omitted.

In the fourth embodiment, the foregoing usual control system for the throttle valve is further including a function 121 for storing opening θth of the throttle valve, a function 122 for calculating deviation Δθth between the previous and present openings of the throttle valve, a function 123 for calculating predicted opening θthe of the throttle valve and a switch 124. The function 121 for storing opening θth of the throttle valve stores the opening θth of the throttle valve detected by the throttle opening sensor 5 at each cycle Ts, the opening θth being stored together with detection time. The function 122 for calculating deviation Δθth between the previous and present openings of the throttle valve calculates the deviation Δθth between the previous opening θtho stored in the function 121 for storing opening θth of the throttle valve and the present opening θth of the throttle valve so as to compare the deviation Δθth with the reference value M (refer to the first embodiment). In accordance with the deviation Δθth between the previous and present openings of the throttle valve calculated by the function 122 for calculating deviation Δθth between the previous and present openings of the throttle valve or in accordance with the past transition of the opening of the throttle valve stored in the function 121 for storing opening θth of the throttle valve, the function 123 for calculating predicted opening θthe of the throttle valve predicts the opening θthe after a lapse of the cycle Ts. The predicted opening θthe of the throttle valve is stored.

The function 122 for calculating deviation Δθth between the previous and present openings of the throttle valve connects the switch 124 to the throttle opening sensor 5 when the deviation Δθth between the previous and present openings of the throttle valve is larger than the reference value M. When the deviation Δθth between the previous and present openings of the throttle valve is smaller than the reference value M, the switch 124 is connected to the function 123 for calculating predicted opening θthe of the throttle valve.

If the deviation Δθth between the previous and present openings of the throttle valve is not smaller than the reference value M, a value detected by the throttle opening sensor 5 is fed back to the PID control function 111. When the deviation Δθth between the previous and present openings of the throttle valve is not larger than the reference value M, the previous predicted opening θthe of the throttle valve stored in the function 123 for calculating predicted opening θthe of the throttle valve is added to the PID control function 111. The foregoing operation will now be described with reference to FIG. 17. In a period from time T (n) to time T (n+2), the value of the throttle sensor indicated with an alternate long and short dash line is added to the PID control function 111. Therefore, the throttle valve can smoothly be operated.

Figure 22:
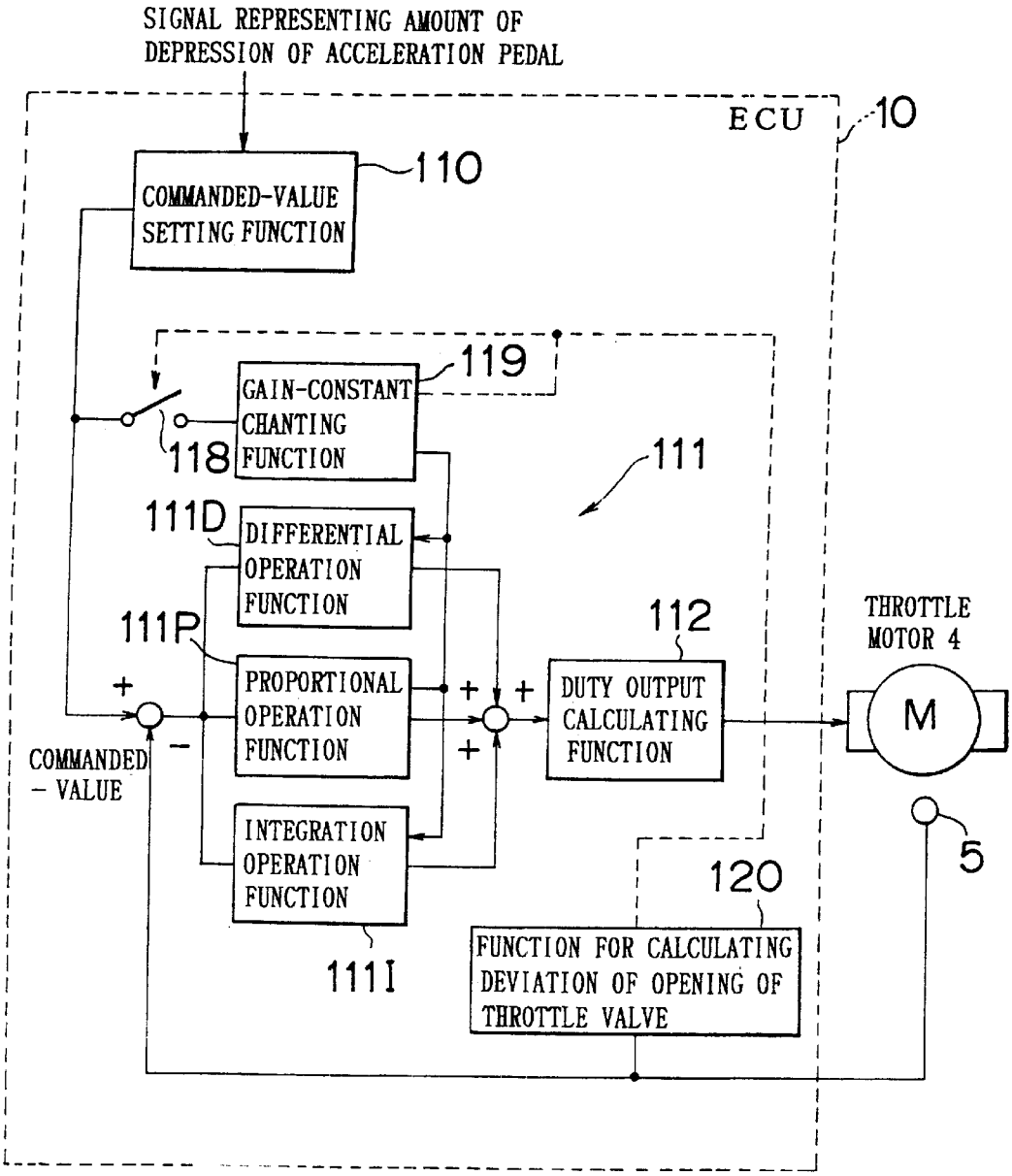
FIG. 22 is a block diagram showing a control operation according to a fifth embodiment of the present invention.

FIG. 22 is a block diagram showing functions of the ECU 10 shown in FIG. 2 to realize a fifth embodiment. The following arrangements are the same as those shown in FIG. 14. The structure of the PID control function 111 of the ECU 10 incorporates the differential operation function 111D, the proportional operation function 111P and integration operation function 111I, the structure of the duty output calculating function 112, and the structure that the opening of the throttle valve which is operated by the throttle motor 4 is detected by the throttle opening sensor 5 so as to be fed back to the PID control function 111. Therefore, the same portions are omitted from illustration.

In the fifth embodiment, the foregoing usual control system for the throttle valve further includes a gain-constant changing switch 118, a gain-constant changing function 119 and a function 120 for calculating the deviation of the opening of the throttle valve. The gain-constant changing function 119 calculates the opening/closing velocity of the throttle valve when the gain-constant changing switch 118 is switched on. To change the amount of offset for changing the rotating force of the throttle motor in accordance with the opening/closing velocity, the gain-constant changing function 119 changes the gains of the differential operation function 111D, the proportional operation function 111P and the integration operation function 111I.

The gain-constant changing switch 118 is switched on/off in accordance with the output of the function 120 for calculating the deviation of the opening of the throttle valve. As described above, the function 120 for calculating the deviation of the opening of the throttle valve calculates the deviation $\Delta\theta th$ between the present opening $\theta th$ of the throttle valve and the previous opening $\theta tho$ of the throttle valve by the cycle Ts to monitor the value of the deviation. When the deviation $\Delta\theta th$ is larger than the reference value K, the function 120 for calculating the deviation of the opening of the throttle valve determines that the opening of the throttle valve is smoothly changed so that the state of the gain-constant changing switch 118 which is switched off is maintained. Then, the deviation $\Delta\theta th$ is stored as the predicted opening $\theta the$ of a next opening of the throttle valve.

If the deviation $\Delta\theta th$ is not larger than the reference value K, the function 120 for calculating the deviation of the opening of the throttle valve determines that the opening of the throttle valve is not smoothly moved. Thus, the function 120 for calculating the deviation of the opening of the throttle valve switches the gain-constant changing switch 118 on. To make the level of the control signal output from the PID control function 111 to the duty output calculating function 112 to be the output level of the control signal realized when the previous predicted opening $\theta the$ of the throttle valve has been supplied to the PID control function 111, the gains of the differential operation function 111D, the proportional operation function 111P and the integration operation function 111I are changed.

Also the gain-constant changing switch 118 is not a mechanical switch and the switch is a flag for operating the gain-constant changing function 119.

As described above, the PID control according to the fifth embodiment, when the deviation $\Delta\theta th$ between the previous and present openings of the throttle valve is not larger than the reference value K, the operation characteristic of the throttle valve 3 can be changed. Therefore, the opening of the throttle valve 3 can smoothly be changed. Therefore, if the opening of the throttle valve passes the opener opening $\theta op$, the force for operating the throttle valve can greatly be changed. As a result, the throttle valve can smoothly be operated in the vicinity of the opener opening.

What is claimed is:

1. A control unit of an internal combustion engine, the control unit comprising:

an accelerator opening sensor for detecting an accelerator opening value corresponding to an accelerator opening in accordance with an amount of depression of an acceleration pedal;

a throttle-valve opening sensor for detecting a throttle valve opening value corresponding to an opening of a throttle valve disposed in a suction passage of the engine;

a motor for opening and closing the throttle valve in accordance with the accelerator opening value and the throttle valve opening value;

commanded-value setting means for reading the accelerator opening value at each of first cycles and setting a commanded value of the throttle valve opening value in accordance with the accelerator opening value;

first opening/closing-velocity setting means for setting a first opening/closing velocity of the throttle valve in accordance with the commanded value;

means for reading an opening of the throttle valve such that the throttle valve opening value detected by the throttle valve opening sensor is read as a present opening of the throttle valve at second cycles shorter than the first cycles;

first throttle-valve-opening predicting means for calculating a first predicted opening of the throttle valve after the second cycle in accordance with the first opening/closing velocity of the throttle valve until the present opening of the throttle valve reaches a predetermined opening smaller than the commanded value;

second opening/closing velocity setting means for setting a second opening/closing velocity of the throttle valve which is lower than the first opening/closing velocity in accordance with the first opening/closing velocity when the present opening of the throttle valve is at least as large as a predetermined opening;

second throttle-valve-opening predicting means for calculating a second predicted opening of the throttle valve after the second cycles in accordance with the second opening/closing velocity of the throttle valve when the present opening of the throttle valve is at least as large as the predetermined opening; and opening/closing means for causing the motor to operate the throttle valve to the commanded value to follow the first and second predicted openings of the throttle valve.

2. A control unit according to claim 1, wherein the first and second throttle-valve opening/closing means calculates a duty ratio of electric power supplied to the motor in accordance with the first and second predicted openings of the throttle valve and rotate the motor in accordance with the calculated duty ratio.

* * * * *